US009601874B2

(12) United States Patent
Tamaki et al.

(10) Patent No.: US 9,601,874 B2
(45) Date of Patent: Mar. 21, 2017

(54) CONNECTOR AND TRANSMISSION LINE STRUCTURE

(71) Applicant: HOSIDEN CORPORATION, Yao-shi (JP)

(72) Inventors: Fumitake Tamaki, Yao (JP); Hayato Kondo, Yao (JP)

(73) Assignee: HOSIDEN CORPORATION, Yao-shi (JP)

( * ) Notice: Subject to any disclaimer, the term of this patent is extended or adjusted under 35 U.S.C. 154(b) by 145 days.

(21) Appl. No.: 14/693,128

(22) Filed: Apr. 22, 2015

(65) Prior Publication Data

US 2015/0311616 A1 Oct. 29, 2015

(30) Foreign Application Priority Data

Apr. 23, 2014 (JP) ..... 2014-088737

(51) Int. Cl.
*H01R 13/6474* (2011.01)

(52) U.S. Cl.
CPC ..... *H01R 13/6474* (2013.01)

(58) Field of Classification Search
CPC ..... H01R 13/6474
See application file for complete search history.

(56) References Cited

U.S. PATENT DOCUMENTS

2015/0311616 A1* 10/2015 Tamaki ..... H01R 13/6474 439/626
2015/0311617 A1* 10/2015 Tamaki ..... H01R 13/405 439/626
2016/0056580 A1* 2/2016 Kondo ..... H01R 13/6473 439/626

FOREIGN PATENT DOCUMENTS

JP 2002-117945 A1 4/2002

* cited by examiner

*Primary Examiner* — James Harvey
(74) *Attorney, Agent, or Firm* — Kratz, Quintos & Hanson, LLP

(57) ABSTRACT

A connector including one and the other first terminals, a second terminal, and a third terminal that are partially held in a body and spaced from each other along a first direction. The middle portion of each first terminal extends obliquely and has parallel edges. The second middle portion of the second terminal extends obliquely and has parallel edges being non-parallel to the edges of the first middle portions. The third terminal extends between the one first terminal and the second terminal and includes a third middle portion extending obliquely. Of the non-parallel edges of the third middle portion, one edge next to the second middle portion is substantially parallel to the edges of the second middle portion, and the other edge next to the first middle portion of the one first terminal is substantially parallel to the edges of the first middle portion of the one first terminal.

19 Claims, 11 Drawing Sheets

CONNECTOR AND TRANSMISSION LINE STRUCTURE

CROSS-REFERENCE TO RELATED APPLICATIONS

The present application claims priority under 35 U.S.C. §119 of Japanese Patent Application No. 2014-088737 filed on Apr. 23, 2014, the disclosure of which is expressly incorporated by reference herein in its entity.

BACKGROUND OF THE INVENTION

Technical Field

The invention relates to connectors and transmission line structures.

Background Art

Japanese Unexamined Patent Publication No. 2002-117945 discloses a conventional connector. The connector has a body, and a plurality of terminals partially held in the body at the same height and spaced from each other along a first direction. The terminals each have a contact portion, a connecting portion, and a middle portion. The connecting portion is disposed diagonally behind the contact portion. The middle portion extends diagonally rearward from the contact portion to the connecting portion. All the middle portions have the same width and are parallel to each other at regular intervals.

SUMMARY OF INVENTION

To arrange the middle portions all having the same width in parallel to each other at regular intervals, it is required to match the inclination angles of all the middle portions of the terminals to the inclination of the middle portion of the furthest terminal in the inclination direction. Such matching ends up an arrangement that the middle portions of the terminals on the side opposite to the terminal inclination direction are inclined at an undesirably large angle. This may lead to degradation of signals transmitted through a pair of differential signal terminals located next to each other on the opposite direction side.

In view of the above-mentioned circumstances, the invention is provides connectors and transmission line structures with reduced signal degradation.

A first connector according to an aspect the invention includes a body having an insulation property and a pair of first terminals, a second terminal, and a third terminal that are partially held in the body at a substantially same height and spaced from each other along a first direction. The first terminals are differential signal terminals being next to each other and extend in a second direction crossing the first direction. One of the first terminals is located on one side in the first direction and the other first terminal is located on the other side in the first direction. The first terminals each include a first contact portion; a first connecting portion on a side in an oblique direction, including a component of the one side in the first direction and a component of the second direction, relative to the first contact portion; and a first middle portion extending from the first contact portion toward the first connecting portion in an oblique direction including a component of the one side in the first direction and a component of the second direction. The first middle portion of each first terminal includes a pair of edges in the first direction. The edges of the first middle portions of the pair of first terminals are parallel to one another. The second terminal is a signal terminal extending in the second direction. The second terminal includes a second contact portion; a second connecting portion on a side in an oblique direction, including a component of the one side in the first direction and a component of the second direction, relative to the second contact portion; and a second middle portion extending from the second contact portion toward the second connecting portion in an oblique direction including a component of the one side in the first direction and a component of the second direction. The second middle portion is more inclined to the one side in the first direction than the first middle portion. The second middle portion includes a pair of edges in the first direction. The edges of the second middle portion are parallel to each other and non-parallel to the edges of the first middle portions. The third terminal is a ground terminal or low-speed signal terminal to transmit a signal at a lower speed than signals transmitted through the first and second terminals. The third terminal extends in the second direction and between the one first terminal and the second terminal. The third terminal includes a third contact portion; a third connecting portion on a side in an oblique direction, including a component of the one side in the first direction and a component of the second direction, relative to the third contact portion; and a third middle portion extending from the third contact portion toward the third connecting portion in an oblique direction including a component of the one side in the first direction and a component of the second direction. The third middle portion includes a pair of edges in the first direction. The edges of the third middle portion are non-parallel to each other and include one edge and the other edge. The one edge of the third middle portion is located next to the second middle portion of the second terminal and is substantially parallel to the edges of the second middle portion of the second terminal. The other edge of the third middle portion is located next to the first middle portion of the one first terminal and substantially parallel to the edges of the first middle portion of the one first terminal.

The first connector of this aspect can reduce degradation of signals transmitted through the pair of first terminals because of the following configuration. The third terminal is a ground terminal or low-speed signal terminal; the third middle portion has a pair of edges non-parallel to each other; one of these edges is next to the second middle portion of the second terminal and substantially parallel to the edges of the second middle portion; and the other edge is next to the first middle portion of the one first terminal and substantially parallel to the edges of the first middle portion of the one first terminal. This configuration allows the inclination of the first middle portions relative to the first contact portions to be smaller than the inclination of the second middle portion relative to the second contact portion, while maintaining parallelism between the edges of the first middle portions of the first terminals. It is therefore possible to reduce degradation of signals transmitted through the first terminals.

The first connector may include a pair of second terminals being differential signal terminals next to each other and including one of the second terminals located on the one side in the first direction and the other second terminal located on the other side in the first direction. The edges of the second middle portions of the pair of second terminals may be parallel to one another and non-parallel to the edges of the first middle portions. The third terminal may be disposed between the one first terminal and the other second terminal. The one edge of the third middle portion of the third terminal may be located next to the second middle portion of the other second terminal and may be substantially parallel to the edges of the second middle portion of the other second terminal.

The first connector may further include a fourth terminal and a fifth terminal. The fourth terminal may be a ground terminal or low-speed signal terminal to transmit a signal at a lower speed than signals transmitted through the first terminals. The fourth terminal may extend in the second direction to be partially held in the body on the other side in the first direction relative to the other first terminal. The fifth terminal may be a ground terminal or low-speed signal terminal to transmit a signal at a lower speed than signals transmitted through the second terminals. The fifth terminal may extend in the second direction to be partially held in the body on the one side in the first direction relative to the one second terminal.

In the first connector of this aspect, impedances can be matched between the first terminals and between the second terminals because of the following configuration. The third terminal, which is a ground terminal or low-speed signal terminal, is disposed on the one side in the first direction relative to the one first terminal, and the fourth terminal, which is a ground terminal or low-speed signal terminal, is disposed on the other side in the first direction relative to the other first terminal. The fifth terminal, which is a ground terminal or low-speed signal terminal, is disposed on the one side in the first direction relative to the one second terminal, and the third terminal, which is a ground terminal or low-speed signal terminal, is disposed on the other side in the first direction relative to the other second terminal.

The fourth terminal may include a fourth contact portion; a fourth connecting portion on a side in a direction, including a component of the second direction, relative to the fourth contact portion; and a fourth middle portion between the fourth contact portion and the fourth connecting portion. The fourth middle portion may include a pair of edges in the first direction. One of the edges of the fourth middle portion may be located next to the first middle portion of the other first terminal and substantially parallel to the edges of the first middle portion of the other first terminal. The fifth terminal may include a fifth contact portion; a fifth connecting portion on a side in a direction, including a component of the second direction, relative to the fifth contact portion; and a fifth middle portion extending between the fifth contact portion and the fifth connecting portion. The fifth middle portion may include a pair of edges in the first direction including one edge and the other edge. The other edge of the fifth middle portion may be located next to the second middle portion of the one second terminal and substantially parallel to the edges of the second middle portion of the one second terminal. The distance between the first middle portion of the one first terminal and the third middle portion of the third terminal may be substantially the same as the distance between the first middle portion of the other first terminal and the fourth middle portion of the fourth terminal. The distance between the second middle portion of the one second terminal and the fifth middle portion of the fifth terminal may be substantially the same as the distance between the second middle portion of the other second terminal and the third middle portion of the third terminal.

The first connector of this aspect is further advantageous in matching impedances between the first terminals and between the second terminals. This is because the distance between the first middle portion of the one first terminal and the third middle portion of the third terminal is substantially the same as the distance between the first middle portion of the other first terminal and the fourth middle portion of the fourth terminal, and because the distance between the second middle portion of the one second terminal and the fifth middle portion is substantially the same as the distance between the second middle portion of the other second terminal and the third middle portion of the third terminal.

The first terminals may each include a boundary portion between the first connecting portion and the first middle portion. The second terminal may further include a boundary portion between the second connecting portion and the second middle portion. The third terminal may further include a boundary portion between the third connecting portion and the third middle portion. The boundary portions of the first, second, and third terminals may be arranged side by side along the first direction.

The largest distance in the first direction between the edges of the third middle portion of the third terminal may be larger than the distance in the first direction between the edges of the first middle portion of each first terminal and than the distance in the first direction between the edges of the second middle portion of the second terminal.

In the first connector of this aspect, it is easy to arrange the edges of the third middle portion of the third terminal as desired. Particularly, the one edge of the third middle portion is substantially parallel to the edges of the first middle portion of the one first terminal, and the other edge of the third middle portion is parallel to the edges of the second middle portion of the other second terminal.

A second connector of an aspect the invention includes a body having an insulation property; and a pair of first terminals, a second terminal, a sixth terminal, and a seventh terminal that are partially held in the body at a substantially same height and spaced from each other along a first direction. The first terminals are differential signal terminals being next to each other and extend in a second direction crossing the first direction. One of the first terminals is located on one side in the first direction and the other first terminal is located on the other side in the first direction. The first terminals each include a first contact portion; a first connecting portion on a side in an oblique direction, including a component of the one side in the first direction and a component of the second direction, relative to the first contact portion; and a first middle portion extending from the first contact portion toward the first connecting portion in an oblique direction including a component of the one side in the first direction and a component of the second direction. The first middle portion includes a pair of edges in the first direction. The edges of the first middle portions of the pair of first terminals are parallel to one another. The second terminal is a signal terminal extending in the second direction. The second terminal includes a second contact portion; a second connecting portion on a side in an oblique direction, including a component of the one side in the first direction and a component of the second direction, relative to the second contact portion; and a second middle portion extending from the second contact portion toward the second connecting portion in an oblique direction including a component of the one side in the first direction and a component of the second direction. The second middle portion is more inclined to the one side in the first direction than the first middle portion. The second middle portion includes a pair of edges in the first direction. The edges of the second terminal are parallel to each other and non-parallel to the edges of the first middle portions. The sixth terminal is a ground terminal or low-speed signal terminal to transmit a signal at a lower speed than signals transmitted through the first and second terminals. The sixth terminal extends in the second direction so as to be located between the one first terminal and the second terminal and next to the one first terminal. The sixth terminal includes a sixth contact portion; a sixth connecting portion on a side in an oblique direction, including a component of the one side in the first direction and a component of the second direction relative to the sixth contact portion; and a sixth middle portion extending from the sixth contact portion toward the sixth connecting portion in an oblique direction including a component of the one side in the first direction and a component of the second direction. The sixth middle portion includes a pair of edges in the first direction. The edges of the sixth middle portion include one edge and the other edge. The other edge of the sixth middle portion is located next to the first middle portion of the one first terminal and substantially parallel to the edges of the first middle portion of the one first terminal. The seventh terminal is a ground terminal or low-speed signal terminal to transmit a signal at a lower speed than signals transmitted through the first and second terminals. The seventh terminal extends in the second direction so as to be located between the one first terminal and the second terminal and next to the second terminal. The seventh terminal includes a seventh contact portion; a seventh connecting portion on a side in an oblique direction, including a component of the one side in the first direction and a component of the second direction, relative to the seventh contact portion; and a seventh middle portion extending from the seventh contact portion toward the seventh connecting portion in an oblique direction including a component of the one side in the first direction and a component of the second direction. The seventh middle portion includes a pair of edges in the first direction. The edges of the seventh middle portion include one edge and the other edge. The one edge of the seventh middle portion is located next to the second middle portion of the second terminal and is substantially parallel to the edges of the second middle portion of the second terminal and non-parallel to the other edge of the sixth middle portion of the sixth terminal.

The second connector of this aspect can reduce degradation of signals transmitted through the pair of first terminals because of the following configuration. The sixth terminal is a ground terminal or low-speed signal terminal; the sixth middle portion has one edge and the other edge, the other edge being located next to the first middle portion of the one first terminal; the seventh terminal is a ground terminal or low-speed signal terminal; the seventh middle portion has one edge and the other edge, the one edge being located next to the second middle portion of the second terminal; the other edge of the sixth terminal is substantially parallel to the edges of the first middle portion of the one first terminal; and the one edge of the seventh terminal is substantially parallel to the edges of the second middle portion of the second terminal and non-parallel to the other edge of the sixth terminal. This configuration allows the inclination of the first middle portions relative to the first contact portions to be smaller than inclination of the second middle portion relative to the second contact portion, while maintaining parallelism between the edges of the first middle portions of the first terminals. It is therefore possible to reduce degradation of signals transmitted through the first terminals.

The second connector may include a pair of second terminals being differential signal terminals next to each other and including one of the second terminals located on the one side in the first direction and the other second terminal located on the other side in the first direction. The edges of the second middle portions of the pair of second terminals may be parallel to one another and non-parallel to the edges of the first middle portions. The sixth terminal may be located between the one first terminal and the other second terminal and next to the one first terminal. The seventh terminal may be located between the one first terminal and the other second terminal and next to the other second terminal. The one edge of the seventh middle portion of the seventh terminal may be located next to the second middle portion of the other second terminal, may be substantially parallel to the edges of the second middle portion of the other second terminal, and may be non-parallel to the other edge of the sixth middle portion of the sixth terminal.

The second connector may further include a fourth terminal and a fifth terminal. The fourth terminal may be a ground terminal or low-speed signal terminal to transmit a signal at a lower speed than signals transmitted through the first terminals. The fourth terminal may extend in the second direction so as to be partially held in the body on the other side in the first direction relative to the other first terminal. The fifth terminal may be a ground terminal or low-speed signal terminal to transmit a signal at a lower speed than signals transmitted through the second terminals. The fifth terminal may extend in the second direction so as to be partially held in the body on the one side in the first direction relative to the one second terminal.

In the second connector of this aspect, impedances can be matched between the first terminals and between the second terminals because of the following configuration. The sixth terminal, which is a ground terminal or low-speed signal terminal, is disposed on the one side in the first direction relative to the one first terminal, and the fourth terminal, which is a ground terminal or low-speed signal terminal, is disposed on the other side in the first direction relative to the other first terminal. The fifth terminal, which is a ground terminal or low-speed signal terminal, is disposed on the one side in the first direction relative to the one second terminal, and the seventh, which is a ground terminal or low-speed signal terminal, is disposed on the other side in the first direction relative to the other second terminal.

The fourth terminal may include a fourth contact portion; a fourth connecting portion on a side in a direction, including a component of the second direction, relative to the fourth contact portion; and a fourth middle portion between the fourth contact portion and the fourth connecting portion. The fourth middle portion may include a pair of edges in the first direction. One of the edges of the fourth middle portion may be located next to the first middle portion of the other first terminal and may be substantially parallel to the edges of the first middle portion of the other first terminal. The fifth terminal may include a fifth contact portion; a fifth connecting portion on a side in a direction, including a component of the second direction, relative to the fifth contact portion; and a fifth middle portion extending between the fifth contact portion and the fifth connecting portion. The fifth middle portion may include a pair of edges in the first direction including one edge and the other edge. The other edge of the fifth middle portion may be located next to the second middle portion of the one second terminal and may be substantially parallel to the edges of the second middle portion of the one second terminal. The distance between the first middle portion of the one first terminal and the sixth middle portion of the sixth terminal may be substantially the same as the distance between the first middle portion of the other first terminal and the fourth middle portion of the fourth terminal. The distance between the second middle portion of the one second terminal and the fifth middle portion of the fifth terminal may be substantially the same as the distance between the second middle portion of the other second terminal and the seventh middle portion of the seventh terminal.

The second connector of this aspect is further advantageous in matching impedances between the first terminals and between the second terminals. This is because the distance between the first middle portion of the one first terminal and the sixth middle portion of the sixth terminal is substantially the same as the distance between the first middle portion of the other first terminal and the fourth middle portion of the fourth terminal, and because the distance between the second middle portion of the one second terminal and the fifth middle portion is substantially the same as the distance between the second middle portion of the other second terminal and the seventh middle portion of the seventh terminal.

The first terminals may each further include a boundary portion between the first connecting portion and the first middle portion. The second terminal may further include a boundary portion between the second connecting portion and the second middle portion. The sixth terminal may further include a boundary portion between the sixth connecting portion and the sixth middle portion. The seventh terminal may further include a boundary portion between the seventh connecting portion and the seventh middle portion. The boundary portions of the first, second, the terminal, and seventh terminals may be arranged side by side along the first direction.

The largest distance in the first direction between the edges of the sixth middle portion of the sixth terminal may be larger than a distance in the first direction between the edges of the first middle portion of each first terminal, and than a distance in the first direction between the edges of the second middle portion of the second terminal. The largest distance in the first direction between the edges of the seventh middle portion of the seventh terminal may be larger than a distance in the first direction between the edges of the first middle portion of each first terminal, and than a distance in the first direction between the edges of the second middle portion of the second terminal.

In the second connector of this aspect, it is easy to arrange the edges of the sixth and seventh middle portions of the sixth and seventh terminals as desired. Particularly, the other edge of the sixth terminal located next to the first middle portion of the one first terminal is substantially parallel to the edges of the first middle portion of the one first terminal, and the one edge of the seventh terminal located next to the second middle portion of the other second terminal is substantially parallel to the edges of the second middle portion of the other second terminal.

A first transmission line structure of an aspect of the invention includes an insulator; and a pair of first lines, a second line, and a third line that are provided on the insulator in spaced relation from each other along a first direction. The first lines are differential signal lines being next to each other and extending in a second direction crossing the first direction. One of the first lines is located on one side in the first direction and the other first line is located on the other side in the first direction. The first lines each include a first contact portion; a first connecting portion on a side in an oblique direction, including a component of the one side in the first direction and a component of the second direction, relative to the first contact portion; and a first middle portion extending from the first contact portion toward the first connecting portion in an oblique direction including a component of the one side in the first direction and a component of the second direction. The first middle portion includes a pair of edges in the first direction. The edges of the first middle portions of the pair of first terminals are parallel to one another. The second line is a signal line extending in the second direction. The second line includes a second contact portion; a second connecting portion on a side in an oblique direction, including a component of the one side in the first direction and a component of the second direction, relative to the second contact portion; and a second middle portion extending from the second contact portion toward the second connecting portion in an oblique direction including a component of the one side in the first direction and a component of the second direction. The second middle portion is more inclined to the one side in the first direction than the first middle portion. The second middle portion includes a pair of edges in the first direction. The edges of the second middle portion are parallel to each other and non-parallel to the edges of the first middle portions. The third line is a ground line or a low-speed signal line to transmit a signal at a lower speed than signals transmitted through the first and second lines. The third line extends in the second direction and between the one first line and the second line. The third line includes a third contact portion; a third connecting portion on a side in an oblique direction, including a component of the one side in the first direction and a component of the second direction, relative to the third contact portion; and a third middle portion extending from the third contact portion toward the third connecting portion in an oblique direction including a component of the one side in the first direction and a component of the second direction. The third middle portion includes a pair of edges in the first direction. The edges of the third middle portion are non-parallel to each other and include one edge and the other edge. The one edge of the third middle portion is located next to the second middle portion of the second line and being substantially parallel to the edges of the second middle portion of the second line. The other edge of the third middle portion is located next to the first middle portion of the one first line and substantially parallel to the edges of the first middle portion of the one first line.

The first transmission line structure of this aspect can reduce degradation of signals transmitted through the pair of first lines because of the following configuration. The third line is a ground line or a low-speed signal line; the third middle portion has a pair of edges non-parallel to each other; one of these edges is next to the second middle portion of the second line and substantially parallel to the edges of the second middle portion; and the other edge is next to the first middle portion of the one first line and substantially parallel to the edges of the first middle portion of the one first line. This configuration allows the inclination of the first middle portions relative to the first contact portions to be smaller than inclination of the second middle portion relative to the second contact portion, while maintaining parallelism between the edges of the first middle portions of the first lines. It is therefore possible to reduce degradation of signals transmitted through the first lines.

The first transmission line structure may include a pair of second lines being differential signal lines next to each other and including one of the second lines located on the one side in the first direction and the other second line located on the other side in the first direction. The edges of the second middle portions of the pair of second lines may be parallel to one another and non-parallel to the edges of the first middle portions. The third line may be disposed between the one first line and the other second line. The one edge of the third middle portion of the third line may be located next to the second middle portion of the other second line and may be substantially parallel to the edges of the second middle portion of the other second line.

The first transmission line structure may further include a fourth line and a fifth line. The fourth line may be a ground line or low-speed signal line to transmit a signal at a lower speed than signals transmitted through the first lines. The fourth line may extend in the second direction on the insulator to be located on the other side in the first direction relative to the other first line. The fifth line may be a ground line or low-speed signal line to transmit a signal at a lower speed than signals transmitted through the second lines. The fifth line may extend in the second direction on the insulator to be located on the one side in the first direction relative to the one second line.

In the first transmission line structure of this aspect, impedances can be matched between the first lines and between the second lines because of the following configuration. The third line, which is a ground line or low-speed signal line, is disposed on the one side in the first direction relative to the one first line, and the fourth line, which is a ground line or low-speed signal line, is disposed on the other side in the first direction relative to the other first line. The fifth line, which is a ground line or low-speed signal line, is disposed on the one side in the first direction relative to the one second line, and the third line, which is a ground line or low-speed signal line, is disposed on the other side in the first direction relative to the other second line.

The fourth line may include a fourth contact portion; a fourth connecting portion on a side in a direction, including a component of the second direction, relative to the fourth contact portion; and a fourth middle portion between the fourth contact portion and the fourth connecting portion. The fourth middle portion may include a pair of edges in the first direction. One of the edges of the fourth middle portion may be located next to the first middle portion of the other first line and substantially parallel to the edges of the first middle portion of the other first line. The fifth line may include a fifth contact portion; a fifth connecting portion on a side in a direction, including a component of the second direction, relative to the fifth contact portion; and a fifth middle portion extending between the fifth contact portion and the fifth connecting portion. The fifth middle portion may include a pair of edges in the first direction including one edge and the other edge. The other edge of the fifth middle portion may be located next to the second middle portion of the one second line and substantially parallel to the edges of the second middle portion of the one second line. The distance between the first middle portion of the one first line and the third middle portion of the third line may be substantially the same as the distance between the first middle portion of the other first line and the fourth middle portion of the fourth line. The distance between the second middle portion of the one second line and the fifth middle portion of the fifth line may be substantially the same as the distance between the second middle portion of the other second line and the third middle portion of the third line.

The first transmission line structure of this aspect is further advantageous in matching impedances between the first lines and between the second lines. This is because the distance between the first middle portion of the one first line and the third middle portion of the third line is substantially the same as the distance between the first middle portion of the other first line and the fourth middle portion of the fourth line, and because the distance between the second middle portion of the one second line and the fifth middle portion is substantially the same as the distance between the second middle portion of the other second line and the third middle portion of the third line.

The first lines may each further include a boundary portion between the first connecting portion and the first middle portion. The second line may further include a boundary portion between the second connecting portion and the second middle portion. The third line may further include a boundary portion between the third connecting portion and the third portion. The boundary portions of the first, second, and third lines may be arranged side by side along the first direction.

The largest distance in the first direction between the edges of the third middle portion of the third line may be larger than a distance in the first direction between the edges of the first middle portion of each first line and than the distance in the first direction between the edges of the second middle portion of the second line.

In the first transmission line structure of this aspect, it is easy to arrange the edges of the third middle portion of the third line as desired. Particularly, the one edge of the third middle portion is substantially parallel to the edges of the first middle portion of the one first line, and the other edge of the third middle portion is parallel to the edges of the second middle portion of the other second line.

A second transmission line structure of an aspect of the invention includes an insulator; and a pair of first lines, a second line, a sixth line, and a seventh line that are provided on the insulator in spaced relation from each other along a first direction. The first lines are differential signal lines being next to each other and extend in a second direction crossing the first direction. One of the first lines is located on one side in the first direction and the other first line is located on the other side in the first direction. The first lines each include a first contact portion; a first connecting portion on a side in an oblique direction, including a component of the one side in the first direction and a component of the second direction, relative to the first contact portion; and a first middle portion extending from the first contact portion toward the first connecting portion in an oblique direction including a component of the one side in the first direction and a component of the second direction. The first middle portion includes a pair of edges in the first direction. The edges of the first middle portions of the pair of first lines are parallel to one another. The second line is a signal line extending in the second direction. The second line includes a second contact portion; a second connecting portion on a side in an oblique direction, including a component of the one side in the first direction and a component of the second direction, relative to the second contact portion; and a second middle portion extending from the second contact portion toward the second connecting portion in an oblique direction including a component of the one side in the first direction and a component of the second direction. The second middle portion is more inclined to the one side in the first direction than the first middle portion. The second middle portion includes a pair of edges in the first direction. The edges of the second line are parallel to each other and non-parallel to the edges of the first middle portions. The sixth line is a ground line or low-speed signal line to transmit a signal at a lower speed than signals transmitted through the first and second lines. The sixth line extends in the second direction so as to be located between the one first line and the second line and next to the one first line. The sixth line includes a sixth contact portion; a sixth connecting portion on a side in an oblique direction, including a component of the one side in the first direction and a component of the second direction, relative to the sixth contact portion; and a sixth middle portion extending from the sixth contact portion toward the sixth connecting portion in an oblique direction including a component of the one side in the first direction and a component of the second direction. The sixth middle portion includes a pair of edges in the first direction including one edge and the other edge. The other edge of the sixth middle portion is located next to the first middle portion of the one first line and substantially parallel to the edges of the first middle portion of the one first line. The seventh line is a ground line or low-speed signal line to transmit a signal at a lower speed than signals transmitted through the first and second lines. The seventh line extends in the second direction so as to be located between the one first line and the second line and next to the second line. The seventh line includes a seventh contact portion; a seventh connecting portion on a side in an oblique direction, including a component of the one side in the first direction and a component of the second direction, relative to the seventh contact portion; and a seventh middle portion extending from the seventh contact portion toward the seventh connecting portion in an oblique direction including a component of the one side in the first direction and a component of the second direction. The seventh middle portion includes a pair of edges in the first direction. The edges of the seventh middle portion include one edge and the other edge. The one edge of the seventh middle portion is located next to the second middle portion of the second terminal and is substantially parallel to the edges of the second middle portion of the second terminal and non-parallel to the other edge of the sixth middle portion of the sixth terminal.

The second transmission line structure of this aspect can reduce degradation of signals transmitted through the pair of first lines because of the following configuration. The sixth line is a ground line or low-speed signal line; the sixth middle portion has one edge and the other edge, the other edge being located next to the first middle portion of the one first line; the seventh line is a ground line or low-speed signal line; the seventh middle portion has one edge and the other edge, the one edge being located next to the second middle portion of the second line; the other edge of the sixth line is substantially parallel to the edges of the first middle portion of the one first line; and the one edge of the seventh line is substantially parallel to the edges of the second middle portion of the second line and non-parallel to the other edge of the sixth line. This configuration allows the inclination of the first middle portions relative to the first contact portions to be smaller than inclination of the second middle portion relative to the second contact portion, while maintaining parallelism between the edges of the first middle portions of the first lines. It is therefore possible to reduce degradation of signals transmitted through the first lines.

The second transmission line structure may include a pair of second lines being differential signal lines next to each other and including one of the second lines located on the one side in the first direction and the other second line located on the other side in the first direction. The edges of the second middle portions of the pair of second lines may be parallel to one another and non-parallel to the edges of the first middle portions. The sixth line may be located between the one first line and the other second line and next to the one first line. The seventh line may be located between the one first line and the other second line and next to the other second line. The one edge of the seventh middle portion of the seventh line may be located next to the second middle portion of the other second line, may be substantially parallel to the edges of the second middle portion of the other second line, and may be non-parallel to the other edge of the sixth middle portion of the sixth line.

The second transmission line structure may further include a fourth line and a fifth line. The fourth line may be a ground line or low-speed signal line to transmit a signal at a lower speed than signals transmitted through the first lines. The fourth line may extend in the second direction on the insulator to be located on the other side in the first direction relative to the other first line. The fifth line may be a ground line or low-speed signal line to transmit a signal at a lower speed than signals transmitted through the second lines. The fifth line may extend in the second direction on the insulator to be located on the one side in the first direction relative to the one second line.

In the second transmission line structure of this aspect, impedances can be matched between the first lines and between the second lines because of the following configuration. The sixth line, which is a ground line or low-speed signal line, is disposed on the one side in the first direction relative to the one first line, and the fourth line, which is a ground line or low-speed signal line, is disposed on the other side in the first direction relative to the other first line. The fifth line, which is a ground line or low-speed signal line, is disposed on the one side in the first direction relative to the one second line, and the seventh, which is a ground line or low-speed signal line, is disposed on the other side in the first direction relative to the other second line.

The fourth line may include a fourth contact portion; a fourth connecting portion on a side in a direction, including a component of the second direction, relative to the fourth contact portion; and a fourth middle portion between the fourth contact portion and the fourth connecting portion. The fourth middle portion may include a pair of edges in the first direction. One of the edges of the fourth middle portion may be located next to the first middle portion of the other first line and may be substantially parallel to the edges of the first middle portion of the other first line. The fifth line may include a fifth contact portion; a fifth connecting portion on a side in a direction, including a component of the second direction, relative to the fifth contact portion; and a fifth middle portion extending between the fifth contact portion and the fifth connecting portion. The fifth middle portion may include a pair of edges in the first direction including one edge and the other edge. The other edge of the fifth middle portion may be located next to the second middle portion of the one second line and may be substantially parallel to the edges of the second middle portion of the one second line. The distance between the first middle portion of the one first line and the sixth middle portion of the sixth line may be substantially the same as the distance between the first middle portion of the other first line and the fourth middle portion of the fourth line. The distance between the second middle portion of the one second line and the fifth middle portion of the fifth line may be substantially the same as the distance between the second middle portion of the other second line and the seventh middle portion of the seventh line.

The second transmission line structure of this aspect is further advantageous in matching impedances between the first lines and between the second lines. This is because the distance between the first middle portion of the one first line and the sixth middle portion of the sixth line is substantially the same as the distance between the first middle portion of the other first line and the fourth middle portion of the fourth line, and because the distance between the second middle portion of the one second line and the fifth middle portion is substantially the same as the distance between the second middle portion of the other second line and the seventh middle portion of the seventh line.

The first lines may each further include a boundary portion between the first connecting portion and the first middle portion. The second line may further include a boundary portion between the second connecting portion and the second middle portion. The sixth line may further include a boundary portion between the sixth connecting portion and the sixth middle portion. The seventh line may further include a boundary portion between the seventh connecting portion and the seventh middle portion. The boundary portions of the first, second, the line, and seventh lines may be arranged side by side along the first direction.

The largest distance in the first direction between the edges of the sixth middle portion of the sixth line may be larger than a distance in the first direction between the edges of the first middle portion of each first line, and than a distance in the first direction between the edges of the second middle portion of the second line. The largest distance in the first direction between the edges of the seventh middle portion of the seventh line may be larger than a distance in the first direction between the edges of the first middle portion of each first line, and than a distance in the first direction between the edges of the second middle portion of the second line.

In the second transmission line structure of this aspect, it is easy to arrange the edges of the sixth and seventh middle portions of the sixth and seventh lines as desired. Particularly, the other edge of the sixth line located next to the first middle portion of the one first line is substantially parallel to the edges of the first middle portion of the one first line, and the one edge of the seventh line located next to the second middle portion of the other second line is substantially parallel to the edges of the second middle portion of the other second line.

DESCRIPTION OF EMBODIMENTS

Connector C in an Embodiment of the Invention

A connector C in an embodiment of the invention will be described below with reference to FIG. 1A to FIG. 5. The connector C includes a case not shown, a body 100, and a terminal group 200. It should be appreciated that X-X' direction indicated in FIG. 2A to FIG. 5 corresponds to the array direction of a plurality of terminals of the terminal group 200 of the connector C and corresponds to the first direction in the claims. In the X-X' direction, the X direction corresponds to the one side in the first direction, and the X' direction corresponds to the other side in the first direction. Y-Y' direction indicated in FIG. 3A to FIG. 5 corresponds to the lengthwise direction of the terminals of the terminal group 200 of the connector C and corresponds to the second direction in the claims. The Y-Y' direction crosses the X-X' direction at right angles. Z-Z' direction indicated in FIGS. 2A and 2B corresponds to the thickness direction of the terminals of the terminal group 200 of the connector C. Z-Z' direction crosses the Y-Y' direction and the X-X' direction at right angles.

The body 100 is made of insulating resin. The body 100 and the terminal group 200 are housed in the case. A space in the case on the Y-direction side from the body 100 serves as a connection hole to receive a mating connector.

Figure 1A:
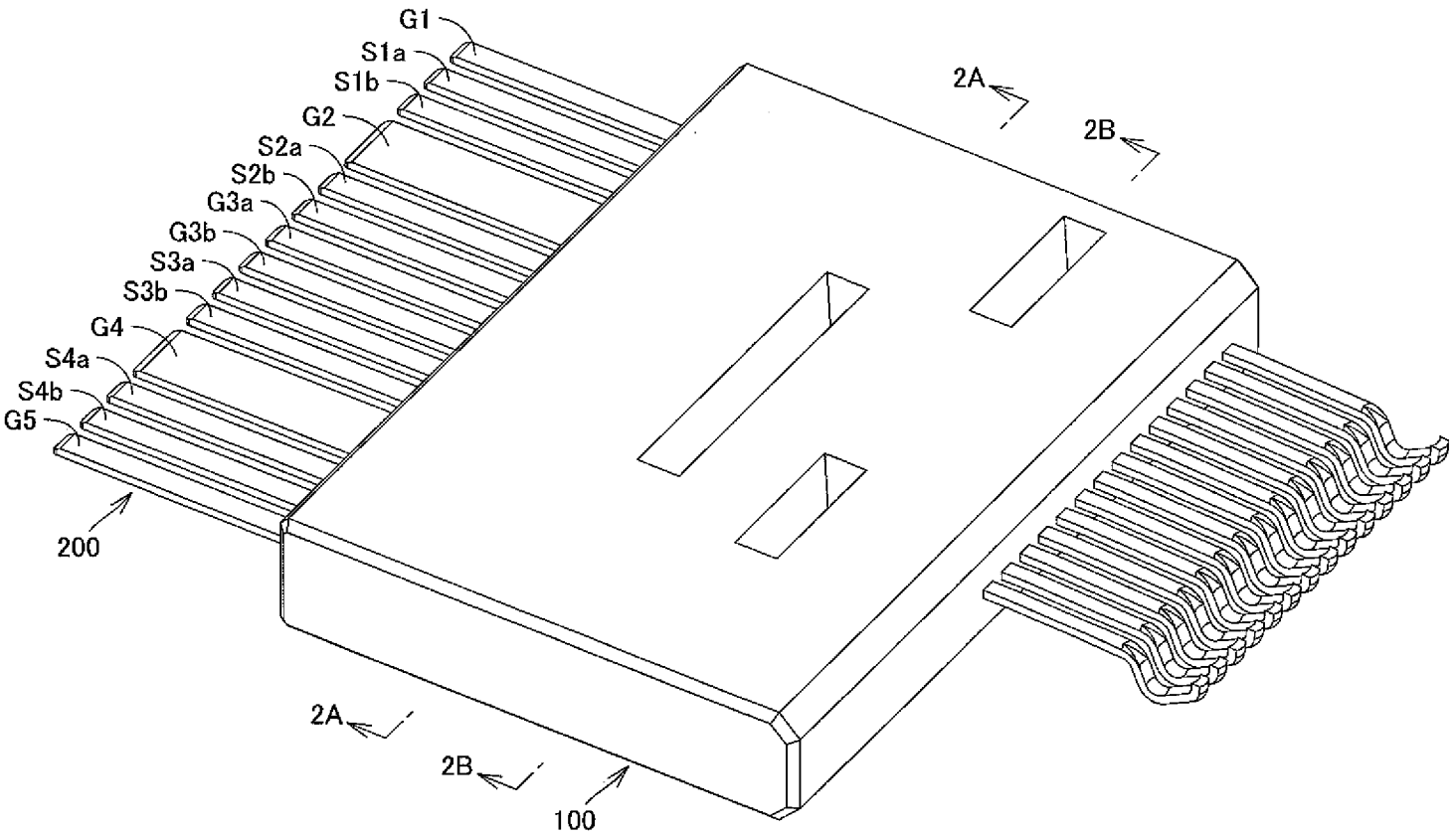
FIG. 1A is a front, top, right side perspective view of a body and a terminal group of a connector in accordance with an embodiment of the invention.
Figure 1B:
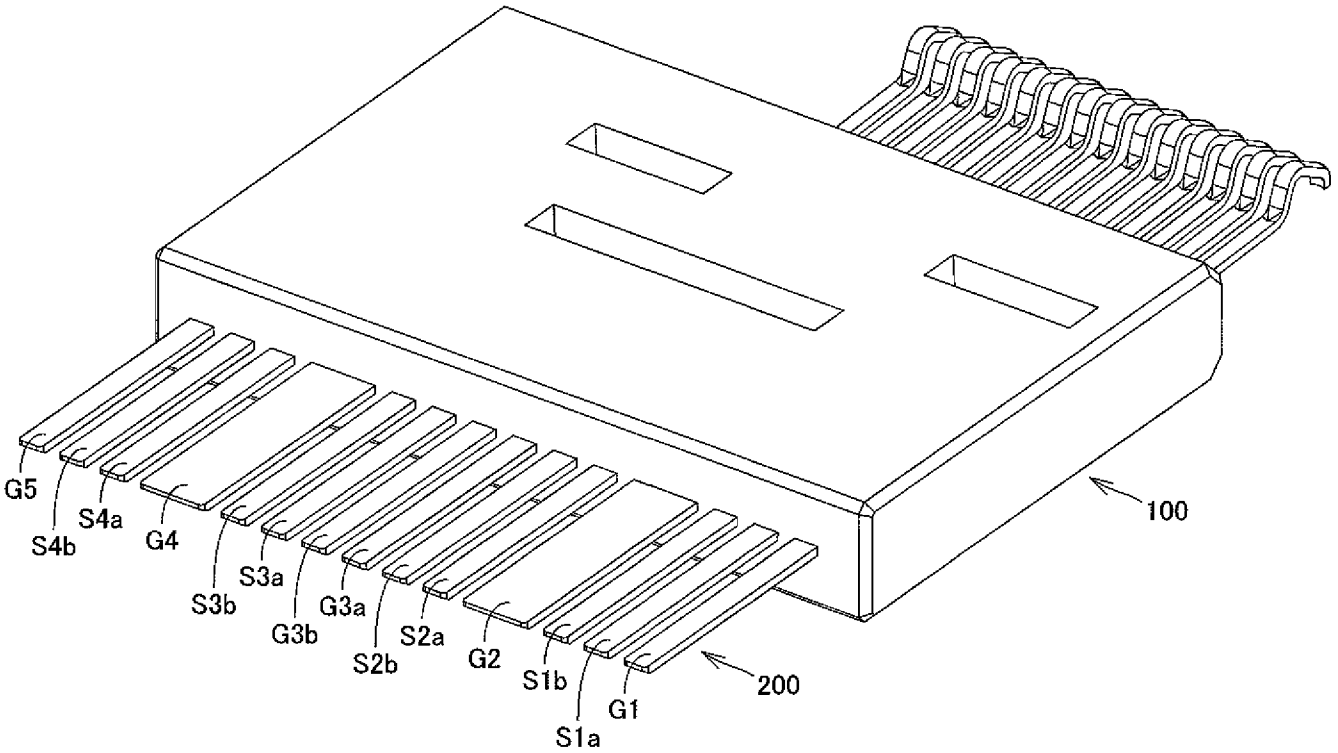
FIG. 1B is a back, bottom, left side perspective view of the body and the terminal group.
Figure 2A:
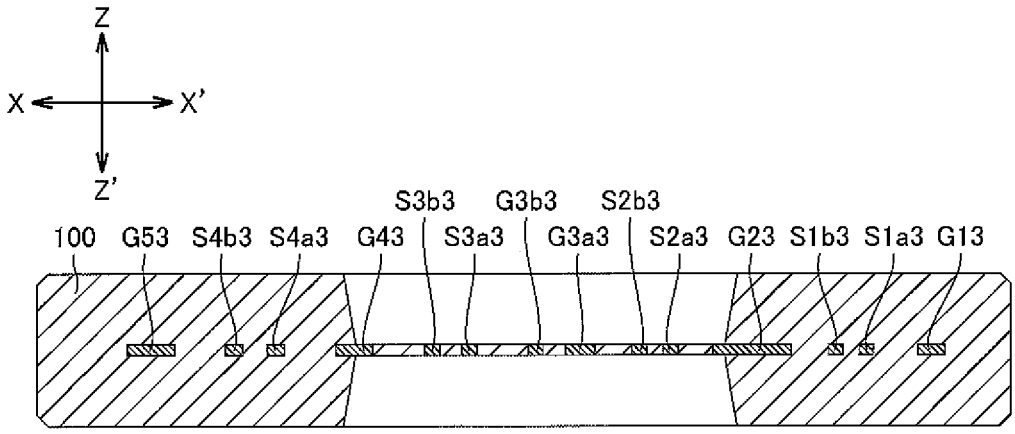
FIG. 2A is a sectional view of the body and the terminal group, taken along 2A-2A in FIG. 1A.
Figure 2B:
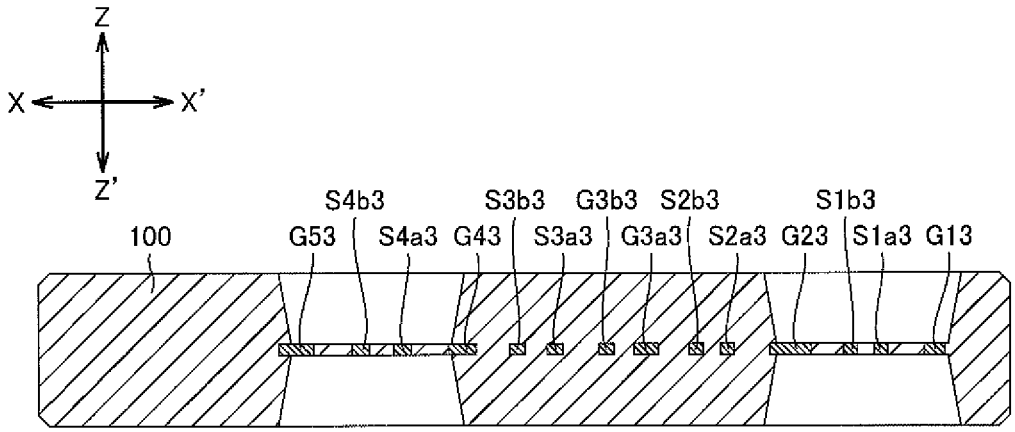
FIG. 2B is a sectional view of the body and the terminal group, taken along 2B-2B in FIG. 1A.
Figure 3A:
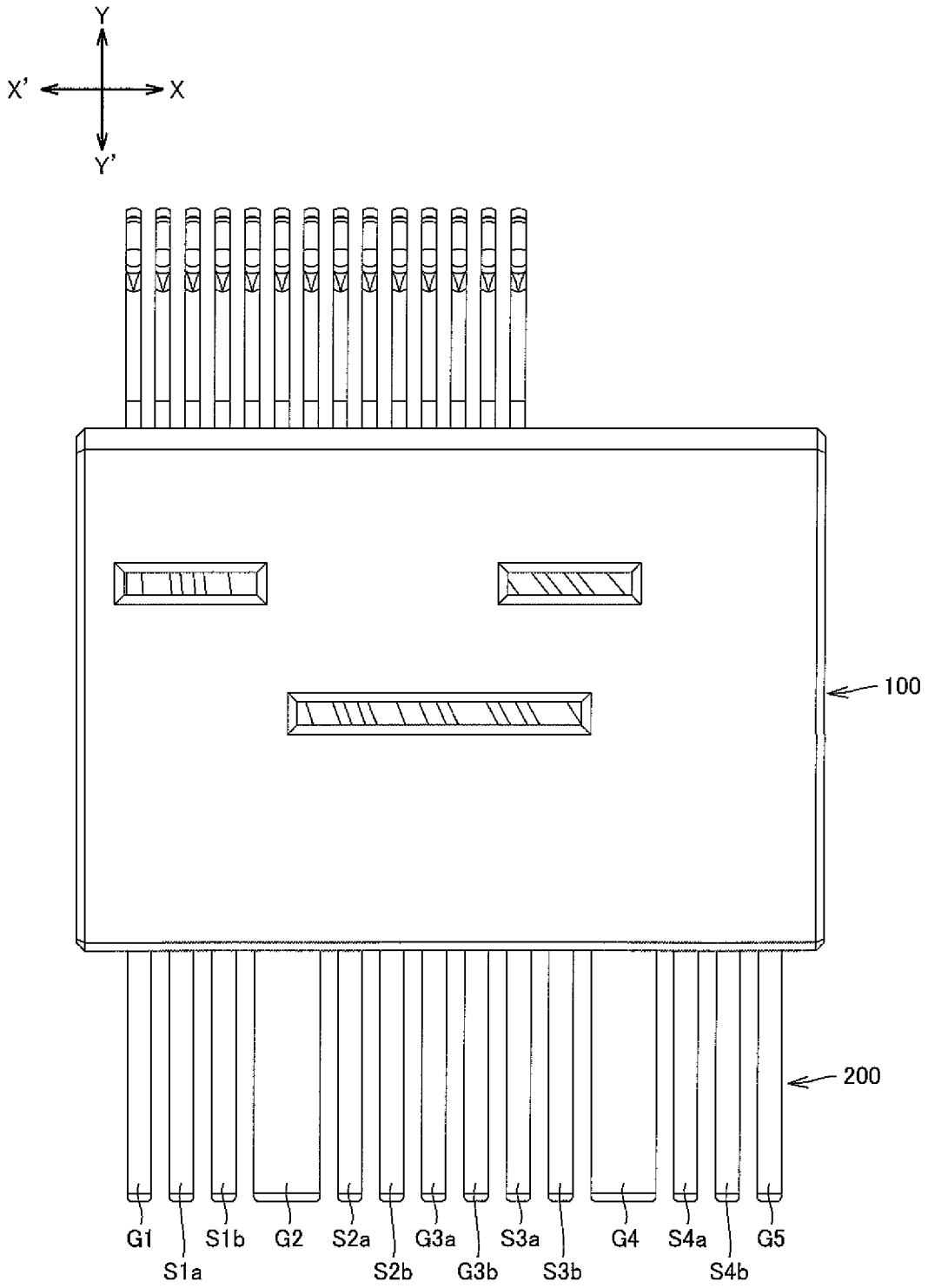
FIG. 3A is a plan view of the body and the terminal group.
Figure 3B:
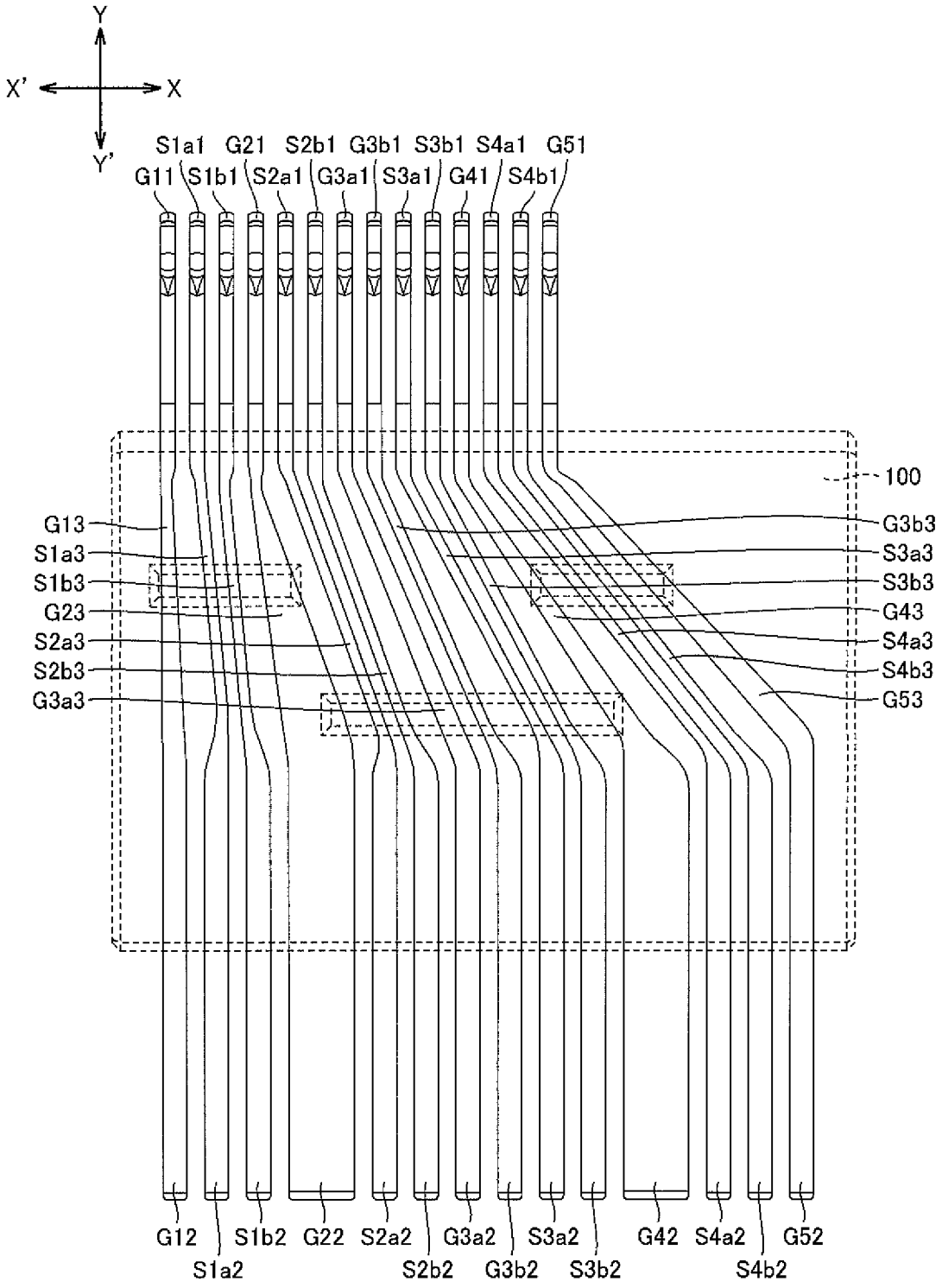
FIG. 3B is a plan view of the body and the terminal group, with the body illustrated in broken lines.
Figure 4A:
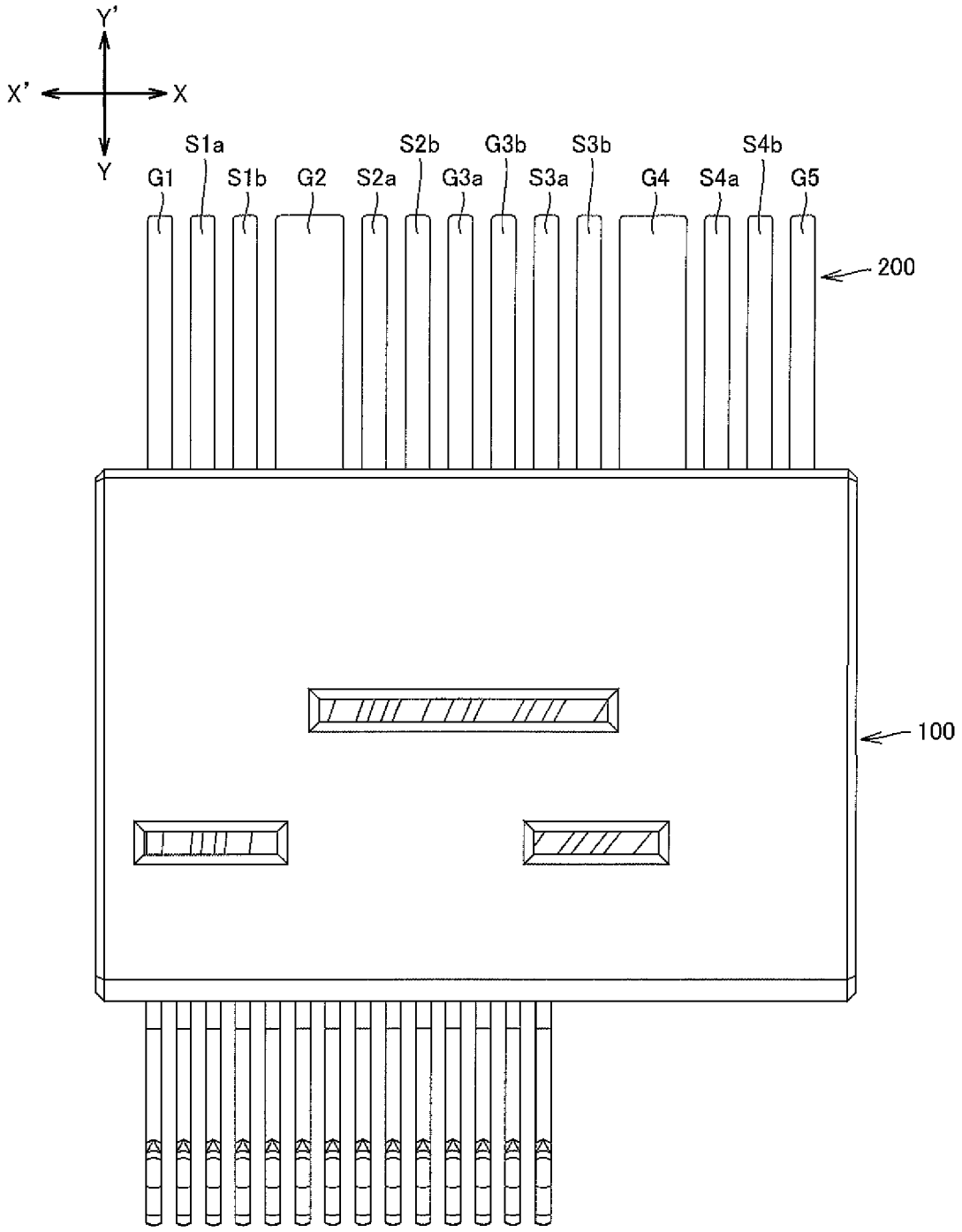
FIG. 4A is a bottom view of the body and the terminal group.
Figure 4B:
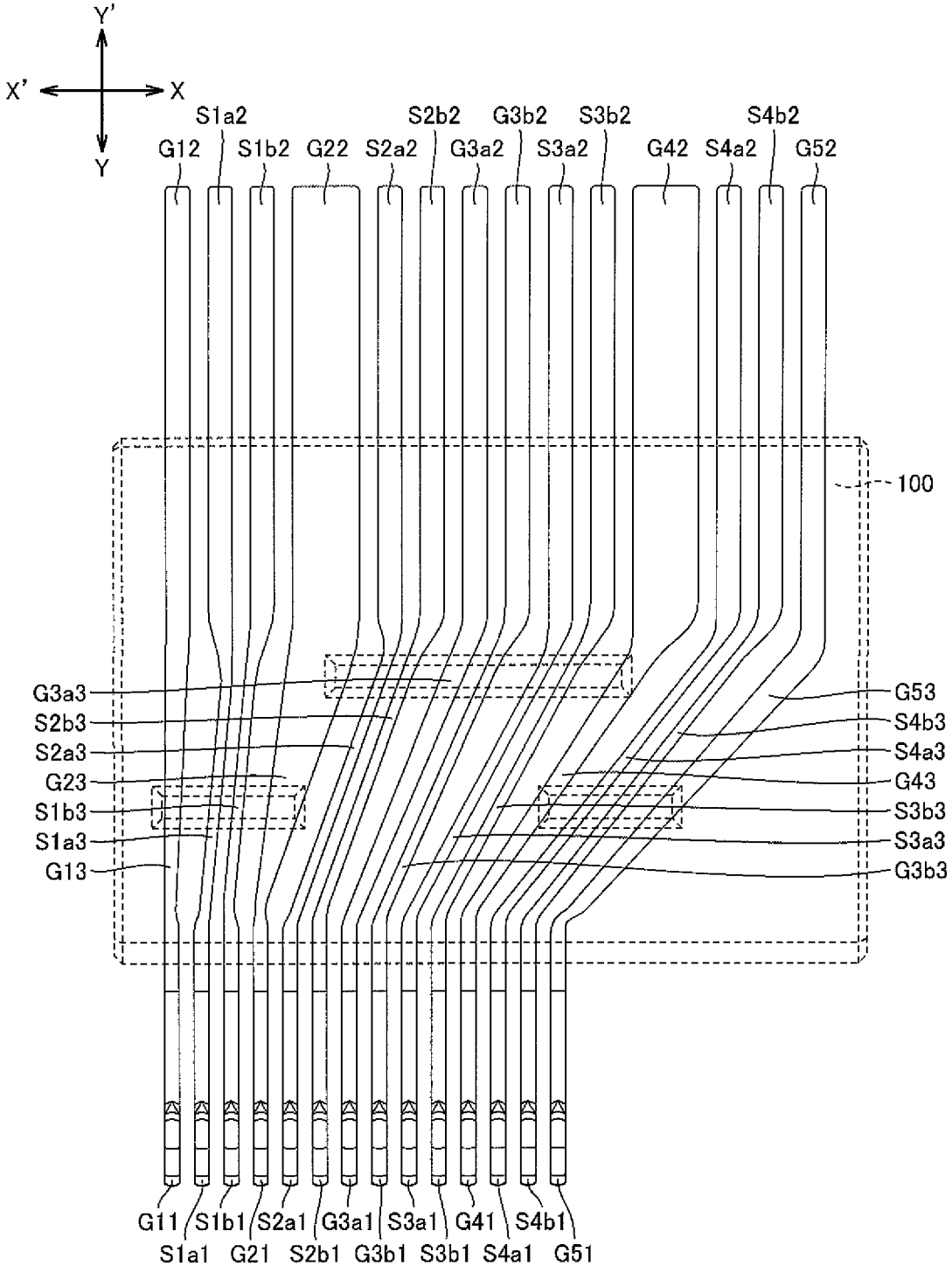
FIG. 4B is a bottom view of the body and the terminal group, with the body illustrated in broken lines.
Figure 5:
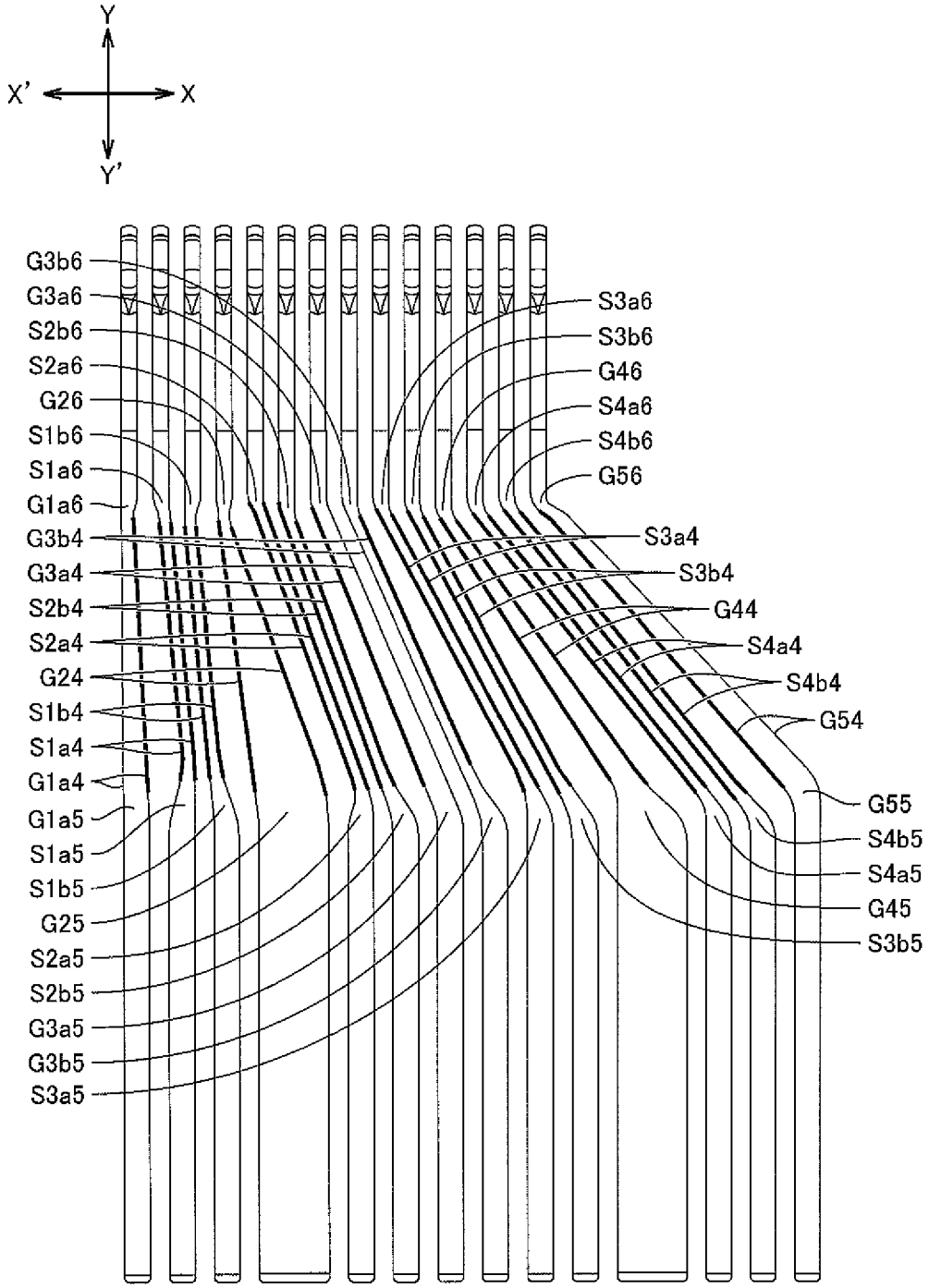
FIG. 5 is a diagrammatic view of the terminal group.

As illustrated in FIG. 1A to FIG. 5, the terminal group 200 includes terminals S1*a*, S1*b*, S2*a*, S2*b*, S3*a*, S3*b*, S4*a*, S4*b*, G1, G2, G3*a*, G3*b*, G4, and G5. The terminals of the terminal group 200 are partially held at the same height (first height) in the body 100 in spaced relation to each other along the X-X' direction in the order of G5, S4*b*, S4*a*, G4, S3*b*, S3*a*, G3*b*, G3*a*, S2*b*, S2*a*, G2, S1*b*, S1*a*, and G1. Specifically, the terminals of the terminal group 200 are insert-molded in the body 100 at the first height, in spaced relation to each other along the X-X' direction in the above order. It should be noted that FIG. 5 illustrates the edges of the middle portions of the terminals of the terminal group 200 are emphasized for convenience of explanation.

As illustrated in FIG. 1A to FIG. 5, the terminals S1*a* and S1*b* are differential signal terminals being located next to each other and extending in the Y-Y' direction. The terminal S1*a* is located on the X'-direction side, and the terminal S1*b* is located on the X-direction side.

The terminal S1*a* includes a contact portion S1*a*1, a connecting portion S1*a*2, and a middle portion S1*a*3. The contact portion S1*a*1 extends in the Y-Y' direction. The contact portion S1*a*1 protrudes from the body 100 in the Y direction so as to be disposed in the connection hole. The distal portion of the contact portion S1*a*1 is bowed in the Z' direction.

The connecting portion S1*a*2 extends in the Y-Y' direction. The connecting portion S1*a*2 is located relative to the contact portion S1*a*1 on a side in an oblique direction including X- and Y'-direction components. The connecting portion S1*a*2 is located at the same height as the contact portion S1*a*1. The connecting portion S1*a*2 has a distal portion and a basal portion. The distal portion of the connecting portion S1*a*2 is the Y-direction side portion of the connecting portion S1*a*2 and is held in the body 100. The basal portion of the connecting portion S1*a*2 is the Y'-direction side portion contiguous with the distal portion of the connecting portion S1*a*2 and protrudes from the body 100 in the Y' direction.

The middle portion S1*a*3 is provided between the contact portion S1*a*1 and the distal portion of the connecting portion S1*a*2, connects between the contact portion S1*a*1 and the connecting portion S1*a*2, and is held in the body 100. The middle portion S1*a*3 extends (is inclined) in an oblique direction including X- and Y'-direction components, from the contact portion S1*a*1 to the connecting portion S1*a*2. The middle portion S1*a*3 includes a pair of edges S1*a*4 in the X-X' direction. The edges S1*a*4 are parallel to each other. In FIG. 5, S1*a*5 denotes a boundary portion between the middle portion S1*a*3 and the connecting portion S1*a*2, and S1*a*6 denotes a boundary portion between the middle portion S1*a*3 and the contact portion S1*a*1.

The terminal S1*b* includes a contact portion S1*b*1, a connecting portion S1*b*2, and a middle portion S1*b*3. The contact portion S1*b*1 has a similar configuration to the contact portion S1*a*1. The contact portion S1*b*1 is in spaced relation to and on the X-direction side from the contact portion S1*a*1 and is disposed in the connection hole.

The connecting portion S1*b*2 is similar in configuration to the connecting portion S1*a*2. The connecting portion S1*b*2 is in spaced relation to and on the X-direction side from the connecting portion S1*a*2. The connecting portion S1*b*2 is located relative to the contact portion S1*b*1 on a side in an oblique direction including X- and Y'-direction components. The connecting portion S1*b*2 S1*a*2 is located at the same height as the contact portion S1*b*1.

The middle portion S1*b*3 is provided between the contact portion S1*b*1 and the distal portion of the connecting portion S1*b*2, connects between the contact portion S1*b*1 and the connecting portion S1*b*2, and is held in the body 100. The middle portion S1*b*3 extends (is inclined) in an oblique direction including X- and Y'-direction components, from the contact portion S1*b*1 to the connecting portion S1*b*2. The middle portion S1*b*3 is in spaced relation to and on the X-direction side from the middle portion S1*a*3. The inclination angle of the middle portion S1*b*3 relative to the contact portion S1*b*1 is the same as that of the middle portion S1*a*3 relative to the contact portion S1*a*1. The middle portion S1*b*3 includes a pair of edges S1*b*4 in the X-X' direction. The edges S1*b*4 are parallel to each other and also to the edges S1*a*4. In FIG. 5, S1*b*5 denotes a boundary portion between the middle portion S1*b*3 and the connecting portion S1*b*2, and S1*b*6 denotes a boundary portion between the middle portion S1*b*3 and the contact portion S1*b*1.

As illustrated in FIG. 1A to FIG. 5, the terminals S2*a* and S2*b* are differential signal terminals extending in the Y-Y' direction and are next to each other on the X-direction side relative to the terminals S1*a* and S1*b*. The terminal S2*a* is located on the X'-direction side, and the terminal S2*b* is located on the X-direction side.

The terminal S2*a* includes a contact portion S2*a*1, a connecting portion S2*a*2, and a middle portion S2*a*3. The contact portion S2*a*1 is similar in configuration to the contact portion S1*a*1. The connecting portion S2*a*2 is similar in configuration to the connecting portion S1*a*2 and located relative to the contact portion S2*a*1 on a side in an oblique direction including X- and Y'-direction components. The connecting portion S2*a*2 is located at the same height as the contact portion S2*a*1.

The middle portion S2*a*3 is provided between the contact portion S2*a*1 and the distal portion of the connecting portion S2*a*2, connects between the contact portion S2*a*1 and the connecting portion S2*a*2, and is held in the body 100. The middle portion S2*a*3 extends (is inclined) in an oblique direction including X- and Y'-direction components, from the contact portion S2*a*1 to the connecting portion S2*a*2. The middle portion S2*a*3 is more inclined to the X-direction side than the middle portions S1*a*3 and S1*b*3. In other words, the inclination angle of the middle portion S2*a*3 relative to the contact portion S2*a*1 is larger than that of the middle portions S1*a*3 and S1*b*3 relative to the contact portions S1*a*1 and S1*b*1, respectively. The middle portion S2*a*3 includes a pair of edges S2*a*4 in the X-X' direction. The edges S2*a*4 are parallel to each other and non-parallel to the edges S1*a*4 and S1*b*4. In FIG. 5, S2*a*5 denotes a boundary portion between the middle portion S2*a*3 and the connecting portion S2*a*2, and S2*a*6 denotes a boundary portion between the middle portion S2*a*3 and the contact portion S2*a*1.

The terminal S2*b* includes a contact portion S2*b*1, a connecting portion S2*b*2, and a middle portion S2*b*3. The contact portion S2*b*1 is similar in configuration to the contact portion S1*b*1 and is in spaced relation to and on the X-direction side relative to the contact portion S2*a*1. The connecting portion S2*b*2 is similar in configuration to the connecting portion S1*b*2. The connecting portion S2*b*2 is in spaced relation to and on the X-direction side relative to the connecting portion S2*a*2 so as to be located on relative to the contact portion S2*b*1 on a side in an oblique direction including X- and Y'-direction components.

The middle portion S2*b*3 is provided between the contact portion S2*b*1 and the distal portion of the connecting portion S2*b*2, connects between the contact portion S2*b*1 and the connecting portion S2*b*2, and is held in the body 100. The middle portion S2*b*3 extends (and is inclined) in an oblique direction including X- and Y'-direction components, from the contact portion S2*b*1 to the connecting portion S2*b*2. The middle portion S2*b*3 is in spaced relation to and on the X-direction side relative to the middle portion S2*a*3. The inclination angle of the middle portion S2*b*3 relative to the contact portion S2*b*1 is the same as that of the middle portion S2*a*3 relative to the contact portion S2*a*1. The middle portion S2*b*3 includes a pair of edges S2*b*4 in the X-X' direction. The edges S2*b*4 are parallel to each other and also parallel to the edges S2*a*4. In FIG. 5, S2*b*5 denotes a boundary portion between the middle portion S2*b*3 and the connecting portion S2*b*2, and S2*b*6 denotes a boundary portion between the middle portion S2*b*3 and the contact portion S2*b*1.

As illustrated in FIG. 1A to FIG. 5, the terminal G2 extends in the Y-Y' direction to be located between the terminal S1*b* and the terminal S2*a*. The terminal G2 may be a ground terminal, or it may be a low-speed signal terminal adapted to transmit signals at a lower speed than signals transmitted through the terminals S1*a*, S1*b*, S2*a*, and S2*b*. For example, such a low-speed signal terminal may be a single-ended signal terminal, a power terminal, or a terminal of other functions adapted to transmit signals of frequency of at most 1/10 or at most 1/100 of the frequency of signals transmitted through the terminals S1*a*, S1*b*, S2*a*, and S2*b*.

The terminal G2 includes a contact portion G21, a connecting portion G22, and a middle portion G23. The contact portion G21 extends in the Y-Y' direction and protrudes from the body 100 in the Y direction so as to be disposed in the connection hole. The distal portion of the contact portion G21 is bowed in the Z' direction. The contact portion G21 is located between and in spaced relation to the contact portion S1*b*1 of the terminal S1*b* and the contact portion S2*a*1 of the terminal S2*a*.

The connecting portion G22 extends in the Y-Y' direction. The connecting portion G22 is located between and in spaced relation to the connecting portion S1*b*2 of the terminal S1*b* and the connecting portion S2*a*2 of the terminal S2*a*. The connecting portion G22 is located relative to the contact portion G21 on a side in an oblique direction including X- and Y'-direction components. The connecting portion G22 is located at the same height as the contact portion G21. The connecting portion G22 has a distal portion and a basal portion. The distal portion of the connecting portion G22 is the Y-direction portion of the connecting portion G22 and is held in the body 100. The basal portion of the connecting portion G22 is the Y'-direction portion contiguous with the distal portion of the connecting portion G22 and protrudes from the body 100 in the Y' direction.

The middle portion G23 is provided between the contact portion G21 and the distal portion of the connecting portion G22, connects between the contact portion G21 and the connecting portion G22, and is held in the body 100. The middle portion G23 extends (is inclined) in an oblique direction including X- and Y'-direction components, from the contact portion G21 to the connecting portion G22. The middle portion G23 is located between and in spaced relation to the middle portion S1*b*3 of the terminal S1*b* and the middle portion S2*a*3 of the terminal S2*a*. The middle portion G23 includes a pair of edges G24 in the X-X' direction. The edges G24 are non-parallel to each other. The middle portion G23 is formed such that the distance (width) in the X-X' direction between the pair of edges G24 gradually increases from the contact portion G21 to the connecting portion G22. At the point where the distance is smallest, this smallest distance is larger than the distance (width) in the X-X' direction between the edges S1*a*4 of the middle portion S1*a*3 of the terminal S1*a*, than the distance (width) in the X-X' direction between the edges S1*b*4 of the middle portion S1*b*3 of the terminal S1*b*, than the distance (width) in the X-X' direction between the edges S2*a*4 of the middle portion S2*a*3 of the terminal S2*a*, and than the distance (width) in the X-X' direction between the edges S2*b*4 of the middle portion S2*b*3 of the terminal S2*b*. Thus designing the width of the middle portion G23 can ensure that the edges G24 are arranged as follows.

The one on the X'-direction side of the edges G24 is located next to the edge S1*b*4 on the X-direction side of the middle portion S1*b*3 of the terminal S1*b* and is substantially parallel to the edges S1*b*4. Specifically, the edge G24 on the X'-direction side preferably extends at an angle of 0 degrees (i.e. parallel to) or ±5 degrees relative to the edges S1*b*4. The edge G24 on the X-direction side is located next to the edge S2*a*4 on the X'-direction side of the middle portion S2*a*3 of the terminal S2*a* and is substantially parallel to the edges S2*a*4. Specifically, the edge G24 on the X-direction side preferably extends at an angle of 0 degrees (i.e. parallel to) or ±5 degrees relative to the edges S2*a*4. The distance between the edge G24 on the X'-direction side and the edge S1*b*4 on the X-direction side is set to be substantially the same as the distance between the edge G24 on the X-direction side and the edge S2*a*4 on the X'-direction side. In FIG. 5, G25 denotes a boundary portion between the middle portion G23 and the connecting portion G22, and G26 denotes a boundary portion between the middle portion G23 and the contact portion G21.

As illustrated in FIG. 1A to FIG. 5, the terminal G1 extends in the Y-Y' direction to be located on the X'-direction side relative to the terminal S1*a*. The terminal G1 may be a ground terminal, or it may be a low-speed signal terminal adapted to transmit signals at a lower speed than signals transmitted through the terminals S1*a* and S1*b*. For example, such a low-speed signal terminal may be a single-ended signal terminal, a power terminal, or a terminal of other functions adapted to transmit signals of frequency of at most 1/10 or at most 1/100 of the frequency of signals transmitted through the terminals S1*a* and S1*b*.

The terminal G1 includes a contact portion G11, a connecting portion G12, and a middle portion G13. The contact portion G11 is similar in configuration to the contact portion G21. The contact portion G11 is in spaced relation to and on the X'-direction side relative to the contact portion S1*a*1 of the terminal S1*a*.

The connecting portion G12 extends in the Y-Y' direction. The connecting portion G12 is located on the Y'-direction side relative to the contact portion G11 (behind the contact portion G11) and in spaced relation to and on the X'-direction side relative to the connecting portion S1*a*2 of the terminal S1*a*. The connecting portion G12 has a distal portion and a basal portion. The distal portion of the connecting portion G12 is the Y-direction side portion of the connecting portion G12 and is held in the body 100. The basal portion of the connecting portion G12 is the Y'-direction side contiguous with the distal portion of the connecting portion S1*a*2 and protrudes from the body 100 in the Y direction.

The middle portion G13 is provided between the contact portion G11 and the distal portion of the connecting portion G12, connects between the contact portion G11 and the connecting portion G12, and is held in the body 100. The middle portion G13 extends in the Y' direction from the contact portion G11 to the connecting portion G12. The middle portion G13 is in spaced relation to and on the X-direction side relative to the middle portion S1*a*3 of the terminal S1*a*. The middle portion G13 includes a pair of edges G14 in the X-X' direction. The edges G14 may preferably be non-parallel to each other but may be parallel to each other. The edges G14 in this embodiment are non-parallel to each other, and the middle portion G13 is accordingly formed such that the distance (width) in the X-X' direction between the edges G14 gradually increases from the contact portion G11 to the connecting portion G12. At the point where the distance is smallest, this smallest distance is larger than the distance (width) in the X-X' direction between the edges S1*a*4 of the middle portion S1*a*3 of the terminal S1*a* and larger than the distance (width) in the X-X' direction between the pair of edges S1*b*4 of the middle portion S1*b*3 of the terminal S1*b*. Thus designing the width of the middle portion G13 can ensure that the edges G14 are arranged as follows.

The one on the X-direction side of the edges G14 is located next to the edge S1*a*4 on the X'-direction side of the middle portion S1*a*3 of the terminal S1*a* and is substantially parallel to the edges S1*a*4. Specifically, the edge G14 on the X-direction side extends preferably at an angle of 0 degrees (i.e. parallel to) or ±5 degrees relative to the edges S1*a*4. The edge G14 on the X'-direction side is substantially parallel to the Y-Y' direction. The distance between the edge G14 on the X-direction side and the edge S1*a*4 on the X'-direction side is set to be substantially the same as the distance between the edge G24 on the X'-direction side and the edge S1*b*4 on the X-direction side. In FIG. 5, G25 denotes a boundary portion between the middle portion G23 and the connecting portion G22, and G26 denotes a boundary portion between the middle portion G23 and the contact portion G21.

As illustrated in FIG. 1A to FIG. 5, the terminals S3*a* and S3*b* are differential signal terminals extending in the Y-Y' direction, and they are next to each other and on the X-direction side relative to the terminals S2*a* and S2*b*. The terminal S3*a* is located on the X'-direction side, and the terminal S3*b* is located on the X-direction side.

The terminal S3*a* includes a contact portion S3*a*1, a connecting portion S3*a*2, and a middle portion S3*a*3. The contact portion S3*a*1 is similar in configuration to the contact portion S1*a*1. The connecting portion S3*a*2 is similar in configuration to the connecting portion S1*a*2 and is located relative to the contact portion S3*a*1 on a side in an oblique direction including X- and Y'-direction components. The connecting portion S3*a*2 is located at the same height as the contact portion S3*a*1.

The middle portion S3*a*3 is provided between the contact portion S3*a*1 and the distal portion of the connecting portion S3*a*2, connects between the contact portion S3*a*1 and the connecting portion S3*a*2, and is held in the body 100. The middle portion S3*a*3 extends (is inclined) in an oblique direction including X- and Y'-direction components, from the contact portion S3*a*1 to the connecting portion S3*a*2. The middle portion S3*a*3 is more inclined to the X-direction side than the middle portions S2*a*3 and S2*b*3. In other words, the inclination angle of the middle portion S3*a*3 relative to the contact portion S3*a*1 is larger than that of the middle portions S2*a*3 and S2*b*3 relative to the contact portions S2*a*1 and S2*b*1, respectively. The middle portion S3*a*3 includes a pair of edges S3*a*4 in the X-X' direction. The edges S3*a*4 are parallel to each other and non-parallel to the edges S2*a*4 and S2*b*4. In FIG. 5, S3*a*5 denotes a boundary portion between the middle portion S3*a*3 and the connecting portion S3*a*2, and S3*a*6 denotes a boundary portion between the middle portion S3*a*3 and the contact portion S3*a*1.

The terminal S3*b* includes a contact portion S3*b*1, a connecting portion S3*b*2, and a middle portion S3*b*3. The contact portion S3*b*1 is similar in configuration to the contact portion S1*b*1 and is in spaced relation to and on the X-direction side relative to the contact portion S3*a*1. The connecting portion S3*b*2 is similar in configuration to the connecting portion S3*a*2. The connecting portion S3*b*2 is located on a side in an oblique direction including X- and Y'-direction components relative to the contact portion S3*a*1. The connecting portion S3*b*2 is located at the same height as the contact portion S3*b*1.

The middle portion S3*b*3 is provided between the contact portion S3*b*1 and the distal portion of the connecting portion S3*b*2, connects between the contact portion S3*b*1 the connecting portion S3*b*2, and is held in the body 100. The middle portion S3*b*3 extends (is inclined) in an oblique direction including X- and Y'-direction components, from the contact portion S3*b*1 to the connecting portion S3*b*2. The middle portion S3*b*3 is in spaced relation to and on the X-direction side relative to the middle portion S3*a*3. The inclination angle of the middle portion S3*b*3 relative to the contact portion S3*b*1 is the same as that of the middle portion S3*a*3 relative to the contact portion S3*a*1. The middle portion S3*b*3 includes a pair of edges S3*b*4 in the X-X' direction. The edges S3*b*4 are parallel to each other and also parallel to the edges S3*a*4. In FIG. 5, S3*b*5 denotes a boundary portion between the middle portion S3*b*3 and the connecting portion S3*b*2, and S3*b*6 denotes a boundary portion between the middle portion S3*b*3 and the contact portion S3*b*1.

As illustrated in FIG. 1A to FIG. 5, the terminals G3*a* and G3*b* extend in the Y-Y' direction and are located next to each other and between the terminal S2*b* and the terminal S3*a*. The terminals G3*a* and G3*b* may be ground terminals, or they may be low-speed signal terminals adapted to transmit signals at a lower speed than signals transmitted through the terminals S2*a*, S2*b*, S3*a*, and S3*b*. For example, the low-speed signal terminals may be single-ended signal terminals, power terminals, or terminals of other functions adapted to transmit signals of frequency of at most 1/10 or at most 1/100 of the frequency of signals transmitted through the terminals S2*a*, S2*b*, S3*a*, and S3*b*. The terminal G3*a* is disposed next to the terminal S2*b*. The terminal G3*b* is disposed next to the terminal S3*a*.

The terminal G3*a* includes a contact portion G3*a*1, a connecting portion G3*a*2, and a middle portion G3*a*3. The contact portion G3*a*1 is similar in configuration to the contact portion G21. The contact portion G3*a*1 is in spaced relation to and on the X-direction side relative to the contact portion S2*b*1 of the terminal S2*b*.

The connecting portion G3*a*2 extends in the Y-Y' direction. The connecting portion G3*a*2 is in spaced relation to and on the X-direction side relative to the connecting portion S2*b*2 of the terminal S2*b*. The connecting portion G3*a*2 is located on a side in an oblique direction including X- and Y'-direction components relative to the contact portion G3*a*1. The connecting portion G3*a*2 is located at the same height as the contact portion G3*a*1. The connecting portion G3*a*2 has a distal portion and a basal portion. The distal portion of the connecting portion G3*a*2 is the Y-direction side portion of the connecting portion G3*a*2 and is held in the body 100. The basal portion of the connecting portion G3*a*2 is the Y'-direction side portion contiguous with the distal portion of the connecting portion G3*a*2 and protrudes from the body 100 in the Y' direction.

The middle portion G3*a*3 is provided between the contact portion G3*a*1 and the distal portion of the connecting portion G3*a*2, connects between the contact portion G3*a*1 and the connecting portion G3*a*2, and is held in the body 100. The middle portion G3*a*3 extends (is inclined) in an oblique direction including X- and Y'-direction components, from the contact portion G3*a*1 to the connecting portion G3*a*2. The middle portion G3*a*3 is in spaced relation to and on the X-direction side relative to the middle portion S2*b*3 of the terminal S2*b*. The middle portion G3*a*3 includes a pair of edges G3*a*4 in the X-X' direction. The edges G3*a*4 may preferably be non-parallel to each other but may be parallel to each other. The one on the X'-direction side of the edges G3*a*4 is located next to the edge S2*b*4 on the X-direction side of the middle portion S2*b*3 of the terminal S2*b* and is substantially parallel to the edges S2*b*4. Specifically, the edge G3*a*4 on the X'-direction side preferably at an angle of 0 degrees (i.e. parallel to) or ±5 degrees relative to the edges S2*b*4. In FIG. 5, G3*a*5 denotes a boundary portion between the middle portion G3*a*3 and the connecting portion G3*a*2, and G3*a*6 denotes a boundary portion between the middle portion G3*a*3 and the contact portion G3*a*1.

The terminal G3*b* includes a contact portion G3*b*1, a connecting portion G3*b*2, and a middle portion G3*b*3. The contact portion G3*b*1 is similar in configuration to the contact portion G3*a*1, and it is located between and in spaced relation to the contact portion G3*a*1 of the terminal G3*a* and the contact portion S3*a*1 of the terminal S3*a*.

The connecting portion G3*b*2 is similar in configuration to the connecting portion G3*a*2, and it is located between and in spaced relation to the connecting portion G3*a*2 of the terminal G3*a* and the connecting portion S3*a*2 of the terminal S3*a*. The connecting portion G3*b*2 is located on a side in an oblique direction including X- and Y'-direction components relative to the contact portion G3*b*1. The connecting portion G3*b*2 is located at the same height as the contact portion G3*b*1.

The middle portion G3*b*3 is provided between the contact portion G3*b*1 and the distal portion of the connecting portion G3*b*2, connects between the contact portion G3*b*1 and the connecting portion G3*b*2, and is held in the body 100. The middle portion G3*b*3 extends (is inclined) in the oblique direction including X- and Y'-direction components from the contact portion G3*b*1 to the connecting portion G3*b*2. The middle portion G3*b*3 is located between and in spaced relation to the middle portion G3*a*3 of the terminal G3*a* and the middle portion S3*a*3 of the terminal S3*a*. The middle portion G3*b*3 includes a pair of edges G3*b*4 in the X-X' direction. The edges G3*b*4 are non-parallel to each other, but may be parallel to each other. The edge G3*b*4 on the X-direction side of the edges G3*b*4 is located next to the edges S3*a*4 of the middle portion S3*a*3 of the terminal S3*a* on the X'-direction side, and is substantially parallel to the edges S3*a*4. Specifically, the edge G3*b*4 on the X-direction side preferably extends at an angle of 0 degrees (i.e. parallel to) or ±5 degrees relative to the edges S3*a*4. The edge G3*b*4 on the X'-direction side of the edges G3*b*4 is substantially parallel to the edge G3*a*4 on the X-direction side of the edges G3*a*4. The distance between the edge G3*b*4 on the X-direction side and the edge S3*a*4 on the X'-direction side is set to be substantially the same as the distance between the edge G3*a*4 on the X'-direction side and the edge S2*b*4 on the X-direction side. In FIG. 5, G3*b*5 denotes a boundary portion between the middle portion G3*b*3 and the connecting portion G3*b*2, and G3*b*6 denotes a boundary portion between the middle portion G3*b*3 and the contact portion G3*b*1.

The terminals S4*a* and S4*b* are differential signal terminals extending in the Y-Y' direction, and are next to each other on the X-direction side relative to the terminals S3*a* and S3*b*. The terminal S4*a* is located on the X'-direction side, and the terminal S4*b* is located on the X-direction side.

The terminal S4*a* includes a contact portion S4*a*1, a connecting portion S4*a*2, and a middle portion S4*a*3. The contact portion S4*a*1 is similar in configuration to the contact portion S1*a*1. The connecting portion S4*a*2 is similar in configuration to the connecting portion S1*a*2 and is disposed on a side in the direction including X- and Y'-direction components (diagonally rearward) relative to the contact portion S4*a*1. The connecting portion S4*a*2 is located at the same height as the contact portion S4*a*1.

The middle portion S4*a*3 is provided between the contact portion S4*a*1 and the distal portion of the connecting portion S4*a*2, connects the contact portion S4*a*1 to the connecting portion S4*a*2, and is held in the body 100. The middle portion S4*a*3 extends (is inclined) in the oblique direction including X- and Y'-direction components from the contact portion S4*a*1 to the connecting portion S4*a*2. The middle portion S4*a*3 is more inclined to the X-direction side than the middle portions S3*a*3 and S3*b*3. In other words, the inclination angle of the middle portion S4*a*3 relative to the contact portion S4*a*1 is larger than that of the middle portions S3*a*3 and S3*b*3 relative to the contact portions S3*a*1 and S3*b*1. The middle portion S4*a*3 includes a pair of edges S4*a*4 in the X-X' direction. The edges S4*a*4 are parallel to each other, and are non-parallel to the edges S3*a*4 and S3*b*4. In FIG. 5, S4*a*5 denotes a boundary portion between the middle portion S4*a*3 and the connecting portion S4*a*2, and S4*a*6 denotes a boundary portion between the middle portion S4*a*3 and the contact portion S4*a*1.

The terminal S4*b* includes a contact portion S4*b*1, a connecting portion S4*b*2, and a middle portion S4*b*3. The contact portion S4*b*1 is similar in configuration to the contact portion S1*b*1 and is in spaced relation to and on the X-direction side from the contact portion S4*a*1. The connecting portion S4*b*2 is similar in configuration to the connecting portion S1*b*2. The connecting portion S4*b*2 is in spaced relation to and on the X-direction side from the connecting portion S4*a*2 so as to be located on a side in an oblique direction including X- and Y'-direction components relative to the contact portion S4*b*1. The connecting portion S4*b*2 is located at the same height as the contact portion S4*b*1.

The middle portion S4*b*3 is provided between the contact portion S4*b*1 and the distal portion of the connecting portion S4*b*2, connects the contact portion S4*b*1 to the connecting portion S4*b*2, and is held in the body 100. The middle portion S4*b*3 extends (is inclined) in an oblique direction including X- and Y'-direction components, from the contact portion S4*b*1 to the connecting portion S4*b*2. The middle portion S4*b*3 is in spaced relation to and on the X-direction side relative to the middle portion S4*a*3. The inclination angle of the middle portion S4*b*3 relative to the contact portion S4*b*1 is the same as that of the middle portion S4*a*3 relative to the contact portion S4*a*1. The middle portion S4*b*3 includes a pair of edges S4*b*4 in the X-X' direction. The edges S4*b*4 are parallel to each other and also parallel to the edges S4*a*4. In FIG. 5, S4*b*5 denotes a boundary portion between the middle portion S4*b*3 and the connecting portion S4*b*2, and S4*b*6 denotes a boundary portion between the middle portion S4*b*3 and the contact portion S4*b*1.

The terminal G4 extends in the Y-Y' direction to be located between the terminal S3*b* and the terminal S4*a*. The terminal G4 may be a ground terminal, or it may be a low-speed signal terminal adapted to transmit signals at a lower speed than signals transmitted through the terminals S3*a*, S3*b*, S4*a*, and S4*b*. For example, such a low-speed signal terminal may be a single-ended signal terminal, a power terminal, or a terminal of other functions adapted to transmit signals of frequency of at most 1/10 or at most 1/100 of the frequency of signals transmitted through the terminals S3*a*, S3*b*, S4*a*, and S4*b*.

The terminal G4 includes a contact portion G41, a connecting portion G42, and a middle portion G43. The contact portion G41 is similar in configuration to the contact portion G21 and is located between and in spaced relation to the contact portion S3*b*1 of the terminal S3*b* and the contact portion S4*a*1 of the terminal S4*a*. The connecting portion G42 is similar in configuration to the connecting portion G22. The connecting portion G42 is located between and in spaced relation to the connecting portion S3*b*2 of the terminal S3*b* and the connecting portion S4*a*2 of the terminal S4*a*. The connecting portion G42 is located on a side in an oblique direction including X- and Y'-direction components relative to the contact portion G41. The connecting portion G42 is located at the same height as the contact portion G41.

The middle portion G43 is provided between the contact portion G41 and the distal portion of the connecting portion G42, connects the contact portion G41 to the connecting portion G42, and is held in the body 100. The middle portion G43 extends (is inclined) in an oblique direction including X- and Y'-direction components, from the contact portion G41 to the connecting portion G42. The middle portion G43 is located between and in spaced relation to the middle portion S3*b*3 of the terminal S3*b* and the middle portion S4*a*3 of the terminal S4*a*. The middle portion G43 includes a pair of edges G44 in the X-X' direction. The edges G44 are non-parallel to each other. The middle portion G43 is formed such that the distance (width) in the X-X' direction between the edges G44 gradually increases from the contact portion G41 to the connecting portion G42. At the point where the distance is smallest, this smallest distance is larger than the distance (width) in the X-X' direction between the edges S3*a*4 of the middle portion S3*a*3 of the terminal S3*a*, than the distance (width) in the X-X' direction between the pair of edges S3*b*4 of the middle portion S3*b*3 of the terminal S3*b*, than the distance (width) in the X-X' direction between the edges S4*a*4 of the middle portion S4*a*3 of the terminal S4*a*, and than the distance (width) in the X-X' direction between the pair of edges S4*b*4 of the middle portion S4*b*3 of the terminal S4*b*. Thus designing the width of the middle portion G43 can ensure that the edges G44 are arranged as follows.

The one on the X'-direction side of the edges G44 is located next to the edge S3*b*4 on the X-direction side of the middle portion S3*b*3 of the terminal S3*b* and is substantially parallel to the edges S3*b*4. Specifically, the edge G44 on the X'-direction side preferably extends at an angle of 0 degrees (i.e. parallel to) or ±5 degrees relative to the edges S3*b*4. The edge G44 on the X-direction side is located next to the edge S4*a*4 on the X'-direction side of the middle portion S4*a*3 of the terminal S4*a* and is substantially parallel to the edges S4*a*4. Specifically, the edge G44 on the X-direction side preferably extends at an angle of 0 degrees (i.e. parallel to) or ±5 degrees relative to the edges S4*a*4. The distance between the edge G44 on the X'-direction side and the edge S3*b*4 on the X-direction side is set to be substantially the same as the distance between the edge G3*b*4 on the X-direction side and the edge S3*a*4 on the X'-direction side, and as the distance between the edge G44 on the X-direction side and the edge S4*a*4 on the X'-direction side. In FIG. 5, G45 denotes a boundary portion between the middle portion G43 and the connecting portion G42, and G46 denotes a boundary portion between the middle portion G43 and the contact portion G41.

The terminal G5 extends in the Y-Y' direction to be located on the X-direction side relative to the terminal S4*b*. The terminal G5 may be a ground terminal, or it may be a low-speed signal terminal adapted to transmit signals at a lower speed than signals transmitted through the terminals S4*a* and S4*b*. For example, such a low-speed signal terminal may be a single-ended signal terminal, a power terminal, or a terminal of other functions adapted to transmit signals of frequency of at most 1/10 or at most 1/100 of the frequency of signals transmitted through the terminals S4*a* and S4*b*.

The terminal G5 includes a contact portion GM, a connecting portion G52, and a middle portion G53. The contact portion G51 is similar in configuration to the contact portion G21, and it is in spaced relation to and on the X-direction side relative to the contact portion S4*b*1 of the terminal S4*b*. The connecting portion G52 is similar in configuration to the connecting portion G22, and it is in spaced relation to and on the X-direction side relative to the connecting portion S4*b*2 of the terminal S4*b*. The connecting portion G52 is located on a side in an oblique direction including X- and Y'-direction components relative to the contact portion G51. The connecting portion G52 is located at the same height as the contact portion G51.

The middle portion G53 is provided between the contact portion GM and the distal portion of the connecting portion G52, connects the contact portion GM to the connecting portion G52, and is held in the body 100. The middle portion G53 extends (is inclined) in an oblique direction including X- and Y'-direction components, from the contact portion G51 to the connecting portion G52. The middle portion G53 is in spaced relation to and on the X-direction side relative to the middle portion S4*b*3 of the terminal S4*b*. The middle portion G53 includes a pair of edges G54 in the X-X' direction. The edges G54 may preferably be non-parallel to each other but may be parallel to each other. The middle portion G53 is formed such that the distance (width) in the X-X' direction between the pair of edges G54 gradually increases from the contact portion G51 to the connecting portion G52. At the point where the distance is smallest, this smallest distance is larger than the distance (width) in the X-X' direction between the edges S4*a*4 of the middle portion S4*a*3 of the terminal S4*a*, and than the distance (width) in the X-X' direction between the pair of edges S4*b*4 of the middle portion S4*b*3 of the terminal S4*b*. Thus designing the width of the middle portion G53 can ensure that the edges G54 are arranged as follows.

The one on the X'-direction side of the edges G54 is located next to the edge S4*b*4 on the X-direction side of the middle portion S4*b*3 of the terminal S4*b* and is substantially parallel to the edges S4*b*4. Specifically, the edge G54 on the X'-direction side extends preferably at an angle of 0 degrees (i.e. parallel to) or ±5 degrees relative to the edges S4*b*4. The distance between the edge G54 on the X'-direction side and the edge S4*b*4 on the X-direction side is set to be substantially the same as the distance between the edge G44 on the X-direction side and the edge S4*a*4 on the X'-direction side. In FIG. 5, G55 denotes a boundary portion between the middle portion G53 and the connecting portion G52, and G56 denotes a boundary portion between the middle portion G53 and the contact portion G51.

The contact portions G11, S1*a*1, S1*b*1, G21, S2*a*1, S2*b*1, G3*a*1, G3*b*1, S3*a*1, S3*b*1, G41, S4*a*1, S4*b*1, and G51 are arranged side by side along the X-X' direction at the same height in connection hole. The connecting portions G12, S1*a*2, S1*b*2, G22, S2*a*2, S2*b*2, G3*a*2, G3*b*2, S3*a*2, S3*b*2, G42, S4*a*2, S4*b*2, and G52 are arranged side by side along the X-X' direction at the same height. The middle portion G13, S1*a*3, S1*b*3, G23, S2*a*3, S2*b*3, G3*a*3, G3*b*3, S3*a*3, S3*b*3, G43, S4*a*3, S4*b*3, and G53 are arranged side by side along the X-X' direction in the body 100. The boundary portions G15, S1*a*5, S1*b*5, G25, S2*a*5, S2*b*5, G3*a*5, G3*b*5, S3*a*5, S3*b*5, G45, S4*a*5, S4*b*5, and G55 are arranged side by side along the X-X' direction. The boundary portions G16, S1*a*6, S1*b*6, G26, S2*a*6, S2*b*6, G3*a*6, G3*b*6, S3*a*6, S3*b*6, G46, S4*a*6, S4*b*6, and G56 are also arranged side by side along the X-X' direction.

When the connector C as described above receives a mating connector in its connection hole, the contact portions of the terminals of the connector C come into contact with contact portions of the mating connector. This is how to connect a mating connector to the connector C. The connecting portions of the terminals of the connector C can be brought into contact with a circuit board or terminals of a different connector. The connector C can thus be connected to the circuit board or the different connector.

Figure 6:
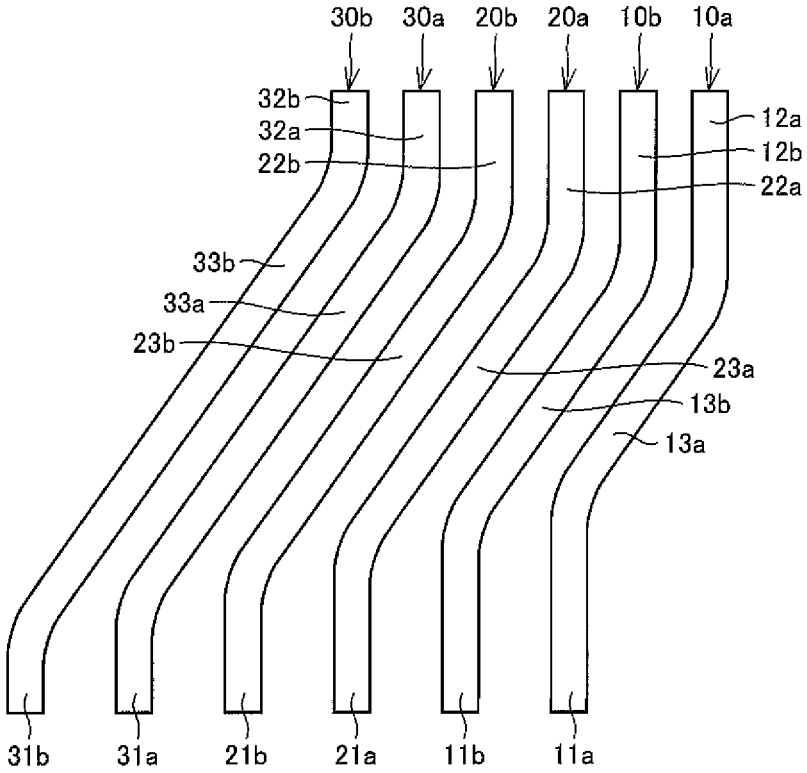
FIG. 6 is a diagrammatic view of a terminal group in a comparative example.

For the purpose of comparison with the terminals of the connector C, a comparative example will be described related to a connector having a terminals 10*a*, 10*b*, 20*a*, 20*b*, 30*a*, and 30*b* as illustrated in FIG. 6. The terminals 10*a*, 10*b*, 20*a*, 20*b*, 30*a*, and 30*b* are arranged in this order and in spaced relation to each other along a direction (horizontal direction in FIG. 6, hereinafter referred to as the "array direction"). The terminals 10*a* and 10*b* are differential signal terminals being next to each other and extending in a direction (vertical direction in FIG. 6, hereinafter referred to as the "orthogonal direction") orthogonal to the array direction. The terminals 10*a* and 10*b* respectively include contact portions 11*a* and 11*b*, connecting portions 12*a* and 12*b*, and middle portions 13*a* and 13*b*. The connecting portions 12*a* and 12*b* are respectively disposed diagonally behind the contact portions 11*a* and 11*b*, respectively. The middle portions 13*a* and 13*b* extend diagonally (are inclined) rearward from the contact portions 11*a* and 11*b* to the connecting portions 12*a* and 12*b*, respectively.

The terminals 30*a* and 30*b* are also differential signal terminals being next to each other and extending in the orthogonal direction. The terminals 30*a* and 30*b* respectively include contact portions 31*a* and 31*b*, connecting portions 32*a* and 32*b*, and middle portions 33*a* and 33*b*. The connecting portions 32*a* and 32*b* are disposed diagonally behind the contact portions 31*a* and 31*b*, respectively. The middle portions 33*a* and 33*b* extend diagonally (are inclined) rearward from the contact portions 31*a* and 31*b* to the connecting portions 32*a* and 32*b*, respectively.

The terminals 20*a* and 20*b* are ground terminals disposed between the terminal 10*b* and the terminal 30*a*. The terminals 20*a* and 20*b* respectively include contact portions 21*a* and 21*b*, connecting portions 22*a* and 22*b*, and middle portions 23*a* and 23*b*. The connecting portions 22*a* and 22*b* are disposed diagonally behind the contact portions 21*a* and 21*b*, respectively. The middle portions 23*a* and 23*b* 33*b* extend diagonally (are inclined) rearward from the contact portions 21*a* and 21*b* to the connecting portions 22*a* and 22*b*, respectively.

The middle portions 13*a*, 13*b*, 23*a*, 23*b*, 33*a*, and 33*b* are inclined relative to the contact portions 11*a*, 11*b*, 21*a*, 21*b*, 31*a*, and 31*b*, respectively, at an angle matching the inclination angle of the middle portion 33*b*. Accordingly, the middle portions 13*a*, 13*b*, 23*a*, 23*b*, 33*a*, and 33*b* are parallel to one another. The middle portions 13*a*, 13*b*, 23*a*, 23*b*, 33*a*, and 33*b* have the same width. The same spacing is provided between the middle portions 13*a* and 13*b*, between the middle portions 13*b* and 23*a*, between the middle portions 23*a* and 23*b*, between the middle portions 23*b* and 33*a*, and between the middle portions 33*a* and 33*b*. The above arrangement ends up an undesirably large inclination angle of the middle portions 13*a* and 13*b* relative to the contact portions 11*a* and 11*b*. In addition, the middle portion 13*a* is smaller in length than the middle portion 13*b*, and the connecting portion 12*a* is larger in length than the connecting portion 12*b*. That is, the terminals 10*a* and 10*b* have very different shapes from each other. As a result, signals transmitted through the terminals 10*a* and 10*b* may suffer noise or losses, resulting in signal degradation.

This is in contrast with the terminals of the connector C. Specifically, Terminal arrangements 1 to 3 will be specifically described below. First, Terminal arrangement 1 relates to the terminals G1, S1*a*, S1*b*, G2, S2*a*, S2*b*, and G3*a*. The edge G24 on the X'-direction side of the terminal G2 is non-parallel to the edge G24 on the X-direction side, the edge G24 on the X'-direction side is substantially parallel to the edges S1*b*4 of the middle portion S1*b*3 of the terminal S1*b*, and the edge G24 on the X-direction side is substantially parallel to the edges S2*a*4 of the middle portion S2*a*3 of the terminal S2*a*. This allows the inclination angle of the middle portions S1*a*3 and S1*b*3 relative to the contact portions S1*a*1 and S1*b*1 to be smaller than the inclination angle of the middle portions S2*a*3 and S2*b*3 relative to the contact portions S2*a*1 and S2*b*1, while maintaining parallelism between the edges S1*a*4 of the middle portion S1*a*3 of the terminal S1*a* and the edges S1*b*4 of the middle portion S1*b*3 of the terminal S1*b*, and maintaining parallelism between the edges S2*a*4 of the middle portion S2*a*3 of the terminal S2*a* and the edges S2*b*4 of the middle portion S2*b*3 of the terminal S2*b*. This means that the inclination angles of the middle portions S1*a*3 and S1*b*3 do not depend on the inclination angles of the middle portions S2*a*3 and S2*b*3, so that it is possible to suppress the difference in length between the middle portions S1*a*3 and S1*b*3 and accordingly suppress the difference in length between the connecting portions S1*a*2, S1*b*2. That is, it is possible to reduce the difference in shape between the terminals S1*a* and S1*b*. This leads to reduction of noise and signal loss of signals transmitted through the terminals S1*a* and S1*b* and reduced degradation of the signals. Further advantageously, the terminal G1 is disposed next to and on the X'-direction side relative to the terminal S1*a*, and the terminal G2 is disposed next to and on the X-direction side relative to the terminal S1*b*; the edge S1*a*4 on the X'-direction side of the terminal S1*a* is substantially parallel to the edge G14 on the X-direction side of the terminal G1; the edge S1*b*4 on the X-direction side of the terminal S1*b* is substantially parallel to the edge G24 on the X'-direction side of the terminal G2; and the distance between the edge S1*a*4 on the X'-direction side of the terminal S1*a* and the edge G14 on the X-direction side of the terminal G1 is substantially the same as the distance between the edge S1*b*4 on the X-direction side of the terminal S1*b* and the edge G24 on the X'-direction side of the terminal G2. This arrangement allows impedance matching between the terminal S1*a* and the terminal S1*b*. Also, the terminal G2 is disposed next to and on the X'-direction side relative to the terminal S2*a*, and the terminal G3*a* is disposed next to and on the X-direction side relative to the terminal S2*b*; the edge S2*a*4 on the X'-direction side of the terminal S2*a* is substantially parallel to the edge G24 on the X-direction side of the terminal G2; the edge S2*b*4 on the X-direction side of the terminal S2*b* is substantially parallel to the edge G3*a*4 on the X'-direction side of the terminal G3*a*; and the distance between the edge S2*a*4 on the X'-direction side of the terminal S2*a* and the edge G24 on the X-direction side of the terminal G2 is substantially the same as the distance between the edge S2*b*4 on the X-direction side of the terminal S2*b* and the edge G3*a*4 on the X'-direction side of the terminal G3*a*. This arrangement allows impedance matching between the terminal S2*a* and the terminal S2*b*. It should be appreciated here (in this paragraph) that the terminals S1*b* and S1*a* respectively correspond to the one and the other first terminals in the claims; the contact portions S1*b*1 and S1*a*1 correspond to the first contact portions in the claims; the connecting portions S1*b*2 and S1*a*2 correspond to the first connecting portions in the claims; the middle portions S1*b*3 and S1*a*3 correspond to the first middle portions in the claims; the terminals S2*b* and S2*a* respectively correspond to the one and the other second terminals in the claims; the contact portions S2*b*1 and S2*a*1 correspond to the second contact portions in the claims; the connecting portions S2*b*2 and S2*a*2 correspond to the second connecting portions in the claims; the middle portions S2*b*3 and S2*a*3 correspond to the second middle portions in the claims; the terminal G2 corresponds to the third terminal in the claims; the contact portion G21 corresponds to the third contact portion in the claims; the connecting portion G22 corresponds to the third connecting portion in the claims; the middle portion G23 corresponds to the third middle portion in the claims; the terminal G1 corresponds to the fourth terminal in the claims; the contact portion G11 corresponds to the fourth contact portion in the claims; the connecting portion G12 corresponds to the fourth connecting portion in the claims; the middle portion G13 corresponds to the fourth middle portion in the claims; the terminal G3*a* corresponds to the fifth terminal in the claims; the contact portion G3*a*1 corresponds to the fifth contact portion in the claims; the connecting portion G3*a*2 corresponds to the fifth connecting portion in the claims; and the middle portion G3*a*3 corresponds to the fifth middle portion in the claims.

Second, Terminal arrangement 2 will be described related to the terminals G2, S2*a*, S2*b*, G3*a*, G3*b*, S3*a*, S3*b*, and G4 of the connector C. The edge G3*a*4 on the X'-direction side of the terminal G3*a* is non-parallel to the edge G3*b*4 on the X-direction side of the terminal G3*b*, the edge G3*a*4 on the X'-direction side is substantially parallel to the edges S2*b*4 of the middle portion S2*b*3 of the terminal S2*b*, and the edge G3*b*4 on the X-direction side is substantially parallel to the edges S3*a*4 of the middle portion S3*a*3 of the terminal S3*a*. This allows the inclination angle of the middle portions S2*a*3 and S2*b*3 relative to the contact portions S2*a*1 and S2*b*1 to be smaller than the inclination angle of the middle portions S3*a*3 and S3*b*3 relative to the contact portions S3*a*1 and S3*b*1, while maintaining parallelism between the edges S2*a*4 of the middle portion S2*a*3 of the terminal S2*a* and the edges S2*b*4 of the middle portion S2*b*3 of the terminal S2*b*, and maintaining parallelism between the edges S3*a*4 of the middle portion S3*a*3 of the terminal S3*a* and the edges S3*b*4 of the middle portion S3*b*3 of the terminal S3*b*. This means that the inclination angles of the middle portions S2*a*3 and S2*b*3 do not depend on the inclination angles of the middle portions S3*a*3 and S3*b*3, so that it is possible to suppress the difference in length between the middle portions S2*a*3 and S2*b*3 and accordingly suppress the difference in length between the connecting portions S2*a*2 and S2*b*2. That is, it is possible to reduce the difference in shape between the terminals S2*a* and S2*b*. This leads to reduction of noise and signal loss of signals transmitted through the terminals S2*a* and S2*b* and reduced degradation of the signals. Further advantageously, the terminal G2 is disposed next to and on the X'-direction side relative to the terminal S2*a*, and the terminal G3*a* is disposed next to and on the X-direction side relative to the terminal S2*b*; the edge S2*a*4 on the X'-direction side of the terminal S2*a* is substantially parallel to the edge G24 on the X-direction side of the terminal G2; the edge S2*b*4 on the X-direction side of the terminal S2*b* is substantially parallel to the edge G3*a*4 on the X'-direction side of the terminal G3*a*; and the distance between the edge S2*a*4 on the X'-direction side of the terminal S2*a* and the edge G24 on the X-direction side of the terminal G2 is substantially the same as the distance between the edge S2*b*4 on the X-direction side of the terminal S2*b* and the edge G3*a*4 on the X'-direction side of the terminal G3*a*. This arrangement allows impedance matching between the terminal S2*a* and the terminal S2*b*. Also, the terminal G3*b* is disposed next to and on the X'-direction side relative to the terminal S3*a*, and the terminal G4 is disposed next to and on the X-direction side relative to the terminal S3*b*; the edge S3*a*4 on the X'-direction side of the terminal S3*a* is substantially parallel to the edge G3*b*4 on the X-direction side of the terminal G3*b*; the edge S3*b*4 on the X-direction side of the terminal S3*b* is substantially parallel to the edge G44 on the X'-direction side of the terminal G4; and the distance between the edge S3*a*4 on the X'-direction side of the terminal S3*a* and the edge G3*b*4 on the X-direction side of the terminal G3*b* is substantially the same as the distance between the edge S3*b*4 on the X-direction side of the terminal S3*b* and the edge G44 on the X'-direction side of the terminal G4. This arrangement allows impedance matching the terminal S3*a* and the terminal S3*b*. It should be appreciated here (in this paragraph) that the terminals S2*b* and S2*a* respectively correspond to the one and the other first terminals in the claims; the contact portions S2*b*1 and S2*a*1 correspond to the first contact portions in the claims; the connecting portions S2*b*2 and S2*a*2 correspond to the first connecting portions in the claims; the middle portions S2*b*3 and S2*a*3 correspond to the first middle portions in the claims; the terminals S3*b* and S3*a* respectively correspond to the one and the other second terminals in the claims; the contact portions S3*b*1 and S3*a*1 correspond to the second contact portions in the claims; the connecting portions S3*b*2 and S3*a*2 correspond to the second connecting portions in the claims; the middle portions S3*b*3 and S3*a*3 correspond to the second middle portions in the claims; the terminal G3*a* corresponds to the sixth terminal in the claims; the contact portion G3*a*1 corresponds to the sixth contact portion in the claims; the connecting portion G3*a*2 corresponds to the sixth connecting portion in the claims; the middle portion G3*a*3 corresponds to the sixth middle portion in the claims; the edge G3*a*4 on the X'-direction side of the middle portion G3*a*3 corresponds to the other edge of the sixth middle portion in the claims; the terminal G3*b* corresponds to the seventh terminal in the claims; the contact portion G3*b*1 corresponds to the seventh contact portion in the claims; the connecting portion G3*b*2 corresponds to the seventh connecting portion in the claims; the middle portion G3*b*3 corresponds to the seventh middle portion in the claims; the terminal G2 corresponds to the fourth terminal in the claims; the contact portion G21 corresponds to the fourth contact portion in the claims; the connecting portion G22 corresponds to the fourth connecting portion in the claims; the middle portion G23 corresponds to the fourth middle portion in the claims; the terminal G4 corresponds to the fifth terminal in the claims; the contact portion G41 corresponds to the fifth contact portion in the claims; the connecting portion G42 corresponds to the fifth connecting portion in the claims; and the middle portion G43 corresponds to the fifth middle portion in the claims.

Lastly, Terminal arrangement 3 will be described related to the terminals G3*b*, S3*a*, S3*b*, G4, S4*a*, S4*b*, and G5 of the connector C. The edge G44 on the X'-direction side of the terminal G4 is non-parallel to the edge G44 on the X-direction side, the edge G44 on the X'-direction side is substantially parallel to the edges S3*b*4 of the middle portion S3*b*3 of the terminal S3*b*, and the edge G44 on the X-direction side is substantially parallel to the edges S4*a*4 of the middle portion S4*a*3 of the terminal S4*a*. This allows the inclination angle of the middle portions S3*a*3 and S3*b*3 relative to the contact portions S3*a*1 and S3*b*1 to be smaller than the inclination angle of the middle portions S4*a*3 and S4*b*3 relative to the contact portions S4*a*1 and S4*b*1, while maintaining parallelism between the edges S3*a*4 of the middle portion S3*a*3 of the terminal S3*a* and the edges S3*b*4 of the middle portion S3*b*3 of the terminal S3*b*, and maintaining parallelism between the edges S4*a*4 of the middle portion S4*a*3 of the terminal S4*a* and the edges S4*b*4 of the middle portion S4*b*3 of the terminal S4*b*. This means that the inclination angles of the middle portions S3*a*3 and S3*b*3 do not depend on the inclination angles of the middle portions S4*a*3 and S4*b*3, so that it is possible to suppress the difference in length between the middle portions S3*a*3 and S3*b*3 and accordingly suppress the difference in length between the connecting portions S3*a*2 and S3*b*2. That is, it is possible to reduce the difference in shape between the terminals S3*a* and S3*b*. This leads to reduction of noise and signal loss of signals transmitted through the terminals S3*a* and S3*b* and reduced degradation of the signals. Further advantageously, the terminal G3*b* is disposed next to and on the X'-direction side relative to the terminal S3*a*, and the terminal G4 is disposed next to and on the X-direction side relative to the terminal S3*b*; the edge S3*a*4 on the X'-direction side of the terminal S3*a* is substantially parallel to the edge G3*b*4 on the X-direction side of the terminal G3*b*; the edge S3*b*4 on the X-direction side of the terminal S3*b* is substantially parallel to the edge G44 on the X'-direction side of the terminal G4; and the distance between the edge S3*a*4 on the X'-direction side of the terminal S3*a* and the edge G3*b*4 on the X-direction side of the terminal G3*b* is substantially the same as the distance between the edge S3*b*4 on the X-direction side of the terminal S3*b* and the edge G44 on the X'-direction side of the terminal G4. This arrangement allows impedance matching between the terminal S3*a* and the terminal S3*b*. Also, the terminal G4 is disposed next to and on the X'-direction side relative to the terminal S4*a*, and the terminal G5 is disposed next to and on the X-direction side relative to the terminal S4*b*; the edge S4*a*4 on the X'-direction side of the terminal S4*a* is substantially parallel to the edge G44 on the X-direction side of the terminal G4; the edge S4*b*4 on the X-direction side of the terminal S4*b* is substantially parallel to the edge G54 on the X'-direction side of the terminal G5; and the distance between the edge S4*a*4 on the X'-direction side of the terminal S4*a* and the edge G44 on the X-direction side of the terminal G4 is substantially the same as the distance between the edge S4*b*4 on the X-direction side of the terminal S4*b* and the edge G54 on the X'-direction side of the terminal G5. This arrangement allows impedance matching between the terminal S4*a* and the terminal S4*b*. It should be appreciated here (in this paragraph) that the terminals S3*b* and S3*a* respectively correspond to the one and the other first terminals in the claims; the contact portions S3*b*1 and S3*a*1 correspond to the first contact portions in the claims; the connecting portions S3*b*2 and S3*a*2 correspond to the first connecting portions in the claims; the middle portions S3*b*3 and S3*a*3 correspond to the first middle portions in the claims; the terminals S4*b* and S4*a* respectively correspond to the one and the other second terminals in the claims; the contact portions S4*b*1 and S4*a*1 correspond to the second contact portions in the claims; the connecting portions S4*b*2 and S4*a*2 correspond to the second connecting portions in the claims; the middle portions S4*b*3 and S4*a*3 correspond to the second middle portions in the claims; the terminal G4 corresponds to the third terminal in the claims; the contact portion G41 corresponds to the third contact portion in the claims; the connecting portion G42 corresponds to the third connecting portion in the claims; the middle portion G43 corresponds to the third middle portion in the claims; the terminal G3*b* corresponds to the fourth terminal in the claims; the contact portion G3*b*1 corresponds to the fourth contact portion in the claims; the connecting portion G3*b*2 corresponds to the fourth connecting portion in the claims; the middle portion G3*b*3 corresponds to the fourth middle portion in the claims; the terminal G5 corresponds to the fifth terminal in the claims; the contact portion G51 corresponds to the fifth contact portion in the claims; the connecting portion G52 corresponds to the fifth connecting portion in the claims; and the middle portion G53 corresponds to the fifth middle portion in the claims.

Transmission Line Structure S in an Embodiment of the Invention

Figure 7A:
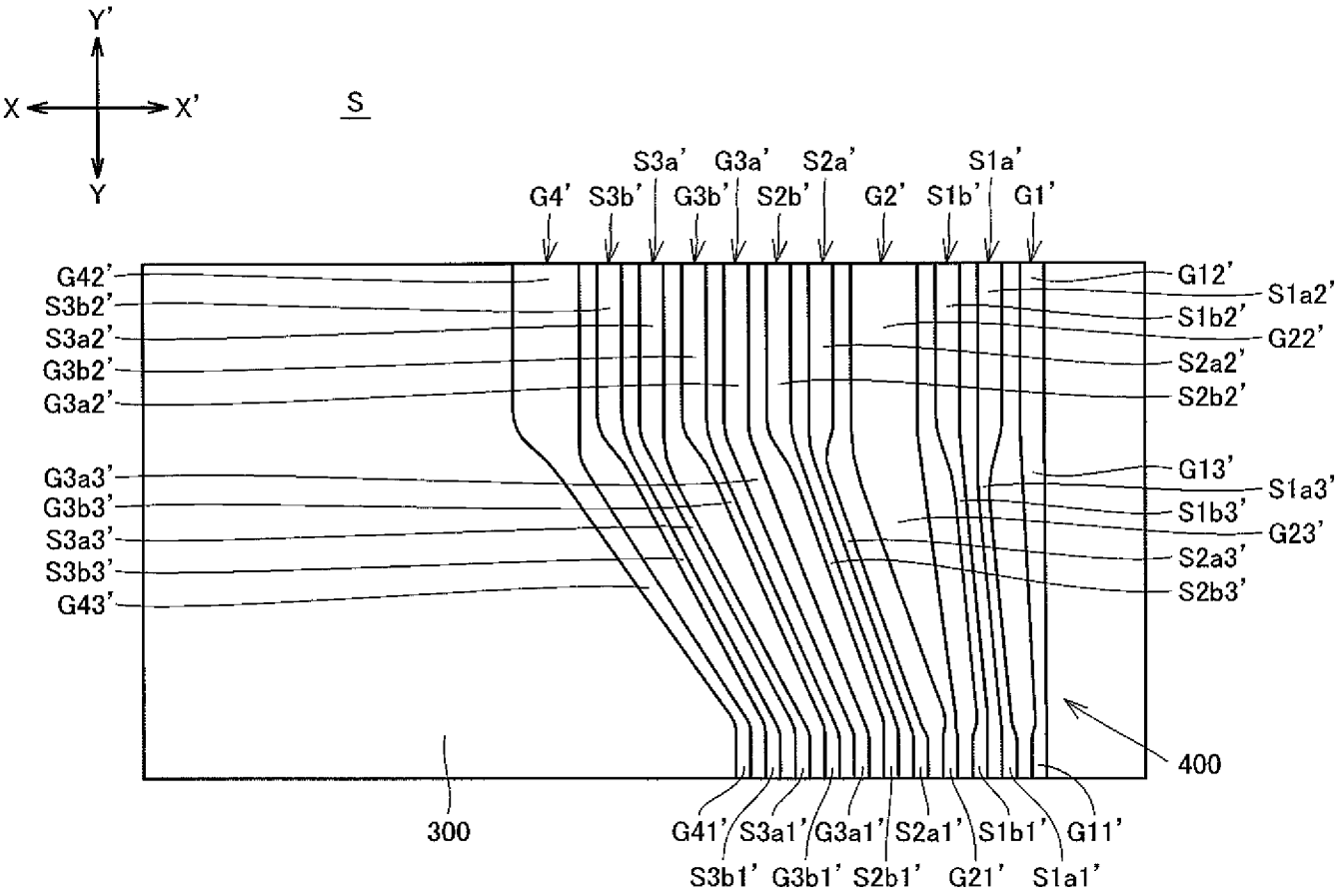
FIG. 7A is a schematic plan view of a transmission line structure in accordance with an embodiment of the invention.
Figure 7B:
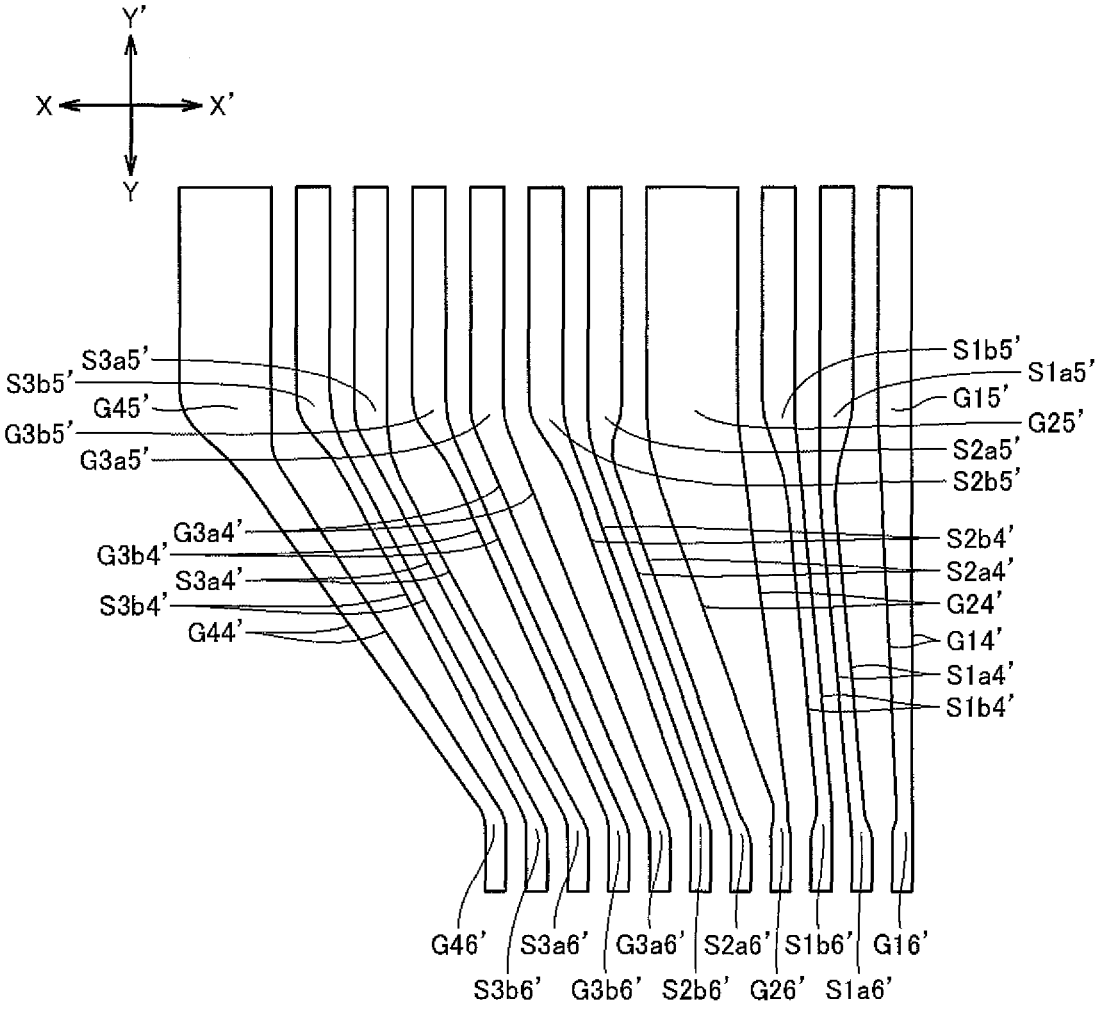
FIG. 7B is an enlarged plan view of some lines of a line group of the transmission line structure.

A transmission line structure S in an embodiment of the invention will be described below with reference to FIG. 7A and FIG. 7B. The structure S includes an insulator 300 and a line group 400. It should be appreciated that X-X' direction in FIG. 7A and FIG. 7B corresponds to the array direction of lines of the line group of the structure S and corresponds to the first direction in the claims. In the X-X' direction, the X direction corresponds to the one side in the first direction, and the X' direction corresponds to the other side in the first direction. Y-Y' direction corresponds to the lengthwise direction of the lines of the line group of the structure S and corresponds to the second direction in the claims. The Y-Y' direction crosses the X-X' direction at right angles.

The insulator 300 is an electrically insulative substrate to be used as a printed circuit board. The line group 400 includes lines S1*a*' and S1*b*', S2*a*', S2*b*', S3*a*', S3*b*', S4*a*', S4*b*', G1', G2', G3*a*', G3*b*', and G4'. The lines of the line group 400 are formed on the insulator 300 in the order of the G4', S3*b*', S3*a*', G3*b*', G3*a*', S2*b*', S2*a*', G2', S1*b*', S1*a*', and G1' in spaced relation to each other along the X-X' direction.

The lines S1*a*' and S1*b*' are differential signal lines being located next to each other and extending in the Y-Y direction. The lines S1*a*' and S1*b*' have substantially the same configuration as those of the terminals S1*a* and S1*b*, respectively, except that they are conductors formed on the insulator 300. The line S1*a*' includes a contact portion S1*a*1', a connecting portion S1*a*2', and a middle portion S1*a*3'. The middle portion S1*a*3' includes a pair of edges S1*a*4' in the X-X' direction. In FIG. 7B, S1*a*5' denotes a boundary portion between the middle portion S1*a*3' and the connecting portion S1*a*2', and S1*a*6' denotes a boundary portion between the middle portion S1*a*3' and the contact portion S1*a*1'. The line S1*b*' includes a contact portion S1*b*1', a connecting portion S1*b*2', and a middle portion S1*b*3'. The middle portion S1*b*3' includes a pair of edges S1*b*4' in the X-X' direction. In FIG. 7B, S1*b*5' denotes a boundary portion between the middle portion S1*b*3' and the connecting portion S1*b*2', and S1*b*6' denotes a boundary portion between the middle portion S1*b*3' and the contact portion S1*b*1'.

The lines S2*a*' and S2*b*' are differential signal lines being located next to each other and extending in the Y-Y direction. The lines S2*a*' and S2*b*' have substantially the same configuration as those of the terminals S2*a* and S2*b*, respectively, except that they are conductors formed on the insulator 300. The line S2*a*' includes a contact portion S2*a*1', a connecting portion S2*a*2', and a middle portion S2*a*3'. The middle portion S2*a*3' includes a pair of edges S2*a*4' in the X-X' direction. In FIG. 7B, S2*a*5' denotes a boundary portion between the middle portion S2*a*3' and the connecting portion S2*a*2', and S2*a*6' denotes a boundary portion between the middle portion S2*a*3' and the contact portion S2*a*1'. The line S2*b*' includes a contact portion S2*b*1', a connecting portion S2*b*2', and a middle portion S2*b*3'. The middle portion S2*b*3' includes a pair of edges S2*b*4' in the X-X' direction. In FIG. 7B, S2*b*5' denotes a boundary portion between the middle portion S2*b*3' and the connecting portion S2*b*2', and S2*b*6' denotes a boundary portion between the middle portion S2*b*3' and the contact portion S2*b*1'.

The line G2' extends in the Y-Y' direction to be located between the line S1*b*' and the line S2*a*'. The line G2' may be a ground line or a low-speed signal line to transmit signals at a lower speed than signals transmitted through the lines S1*a*', S1*b*', S2*a*', and S2*b*'. For example, such a low-speed signal line may be a single-ended signal line, a power line, or a line of other functions adapted to transmit signals of frequency of at most 1/10 or at most 1/100 of the frequency of signals transmitted through the lines S1*a*', S1*b*', S2*a*', and S2*b*'. The line G2' has substantially the same configuration as the terminal G2, except that it is a conductor formed on the insulator 300. The line G2' includes a contact portion G21', a connecting portion G22', and a middle portion G23'. The middle portion G23' includes a pair of edges G24' in the X-X' direction. In FIG. 7B, G25' denotes a boundary portion between the middle portion G23' and the connecting portion G22', and G26' denotes a boundary portion between the middle portion G23' and the contact portion G21'.

The line G1' extends in the Y-Y' direction to be located on the X'-direction side relative to the line S1*a*'. The line G1' may be a ground line or a low-speed signal line to transmit signals at a lower speed than signals transmitted through the lines S1*a*' and S1*b*'. For example, such a low-speed signal line may be a single-ended signal line, a power line, or a line of other functions adapted to transmit signals of frequency of at most 1/10 or at most 1/100 of the frequency of signals transmitted through the lines S1*a*' and S1*b*'. The line G1' has substantially the same configuration as the terminal G1, except that it is a conductor formed on the insulator 300. The line G1' includes a contact portion G11', a connecting portion G12', and a middle portion G13'. The middle portion G13' includes a pair of edges G14' in the X-X' direction. In FIG. 7B, G15' denotes a boundary portion between the middle portion G13' and the connecting portion G12', and G16' denotes a boundary portion between the middle portion G13' and the contact portion G11'.

The lines S3*a*' and S3*b*' are differential signal lines being located next to each other and extending in the Y-Y direction. The lines S3*a*' and S3*b*' have substantially the same configuration as the terminals S3*a* and S3*b*, respectively, except that they are conductors formed on the insulator 300. The line S3*a*' includes a contact portion S3*a*1', a connecting portion S3*a*2', and a middle portion S3*a*3'. The middle portion S3*a*3' includes a pair of edges S3*a*4' in the X-X' direction. In FIG. 7B, S3*a*5' denotes a boundary portion between the middle portion S3*a*3' and the connecting portion S3*a*2', and S3*a*6' denotes a boundary portion between the middle portion S3*a*3' and the contact portion S3*a*1'. The line S3*b*' includes a contact portion S3*b*1', a connecting portion S3*b*2', and a middle portion S3*b*3'. The middle portion S3*b*3' includes a pair of edges S3*b*4' in the X-X' direction. In FIG. 7B, S3*b*5' denotes a boundary portion between the middle portion S3*b*3' and the connecting portion S3*b*2', and S3*b*6' denotes a boundary portion between the middle portion S3*b*3' and the contact portion S3*b*1'.

The lines G3*a*' and G3*b*' extends in the Y-Y' direction to be located next to each other between the line S2*b*' and the line S3*a*'. The lines G3*a*' and G3*b*' may be ground lines or low-speed signal lines to transmit signals at a lower speed than signals transmitted through the lines S2*a*', S2*b*', S3*a*', and S3*b*'. For example, such low-speed signal lines may be single-ended signal lines, power lines, or lines of other functions adapted to transmit signals of frequency of at most 1/10 or at most 1/100 of the frequency of signals transmitted through the lines S2*a*' and S2*b*', S3*a*', and S3*b*'. The line G3*a*' is located next to the line S2*b*'. The line G3*b*' is located next to the line S3*a*'.

The lines G3*a*' and G3*b*' have substantially the same configuration as the terminals G3*a* and G3*b*, respectively, except that they are conductors formed on the insulator 300. The line G3*a*' includes a contact portion G3*a*1', a connecting portion G3*a*2', and a middle portion G3*a*3'. The middle portion G3*a*3' includes a pair of edges G3*a*4' in the X-X' direction. In FIG. 7B, G3*a*5' denotes a boundary portion between the middle portion G3*a*3' and the connecting portion G3*a*2', and G3*a*6' denotes a boundary portion between the middle portion G3*a*3' and the contact portion G3*a*1'. The line G3*b*' includes a contact portion G3*b*1', a connecting portion G3*b*2', and a middle portion G3*b*3'. The middle portion G3*b*3' includes a pair of edges G3*b*4' in the X-X' direction. In FIG. 7B, G3*b*5' denotes a boundary portion between the middle portion G3*b*3' and the connecting portion G3*b*2', and G3*b*6' denotes a boundary portion between the middle portion G3*b*3' and the contact portion G3*b*1'.

The line G4' extends in the Y-Y' direction to be located on the X-direction side relative to the line S3*b*'. The line G4' may be a ground line or a low-speed signal line to transmit signals at a lower speed than signals transmitted through the lines S3*a*' and S3*b*'. For example, such a low-speed signal line may be a single-ended signal line, a power line, or a line of other functions adapted to transmit signals of frequency of at most 1/10 or at most 1/100 of the frequency of signals transmitted through the lines S3*a*' and S3*b*'. The line G4' has substantially the same configuration as the terminal G4, except that it is a conductor formed on the insulator 300. The line G4' includes a contact portion G41', a connecting portion G42', and a middle portion G43'. The middle portion G43' includes a pair of edges G44' in the X-X' direction. In FIG. 7B, G45' denotes a boundary portion between the middle portion G43' and the connecting portion G42', and G46' denotes a boundary portion between the middle portion G43' and the contact portion G41'.

Line arrangements 1 and 2 of the lines of the transmission line structure S will be specifically described below. First, Line arrangement 1 relates to the lines G1', S1*a*', S1*b*', G2', S2*a*', S2*b*', and G3*a*', the edges G24' on the X'- and X-direction sides of the line G2' are non-parallel to each other, the edge G24' on the X'-direction side is substantially parallel to the edges S1*b*4' of the middle portion S1*b*3' of the line S1*b*' (the edge G24' on the X'-direction side extends at an angle of 0 degrees (i.e. parallel to) or ±5 degrees relative to the edges S1*b*4'), and the edge G24' on the X-direction side is substantially parallel to the edges S2*a*4' of the middle portion S2*a*3' of the line S2*a*' (the edge G24' on the X-direction side extends at an angle of 0 degrees (i.e. parallel to) or ±5 degrees relative to the edges S2*a*4'). This allows the inclination angle of the middle portions S1*a*3' and S1*b*3' relative to the contact portions S1*a*1' and S1*b*1' to be smaller than the inclination angle of the middle portions S2*a*3' and S2*b*3' relative to the contact portions S2*a*1' and S2*b*1', while maintaining parallelism between the edges S1*a*4' of the middle portion S1*a*3' of the line S1*a*' and the edges S1*b*4' of the middle portion S1*b*3' of the line S1*b*', and maintaining parallelism between the edges S2*a*4' of the middle portion S2*a*3' of the line S2*a*' and the edges S2*b*4' of the middle portion S2*b*3' of the line S2*b*'. This means that the inclination angles of the middle portions S1*a*3', S1*b*3' do not depend on the inclination angles of the middle portions S2*a*3' and S2*b*3', so that it is possible to suppress the difference in length between the middle portions S1*a*3' and S1*b*3' and accordingly suppress the difference in length between the connecting portions S1*a*2' and S1*b*2'. That is, it is possible to reduce the difference in shape between the lines S1*a*' and S1*b*'. This leads to reduction of noise and signal loss of signals transmitted through the lines S1*a*' and S1*b*' and reduced degradation of the signals. Further advantageously, the line G1' is disposed next to and on the X'-direction side relative to the line S1*a*', and the line G2' is disposed next to and on the X-direction side relative to the line S1*b*'; the edge S1*a*4' on the X'-direction side of the line S1*a*' is substantially parallel to the edge G14' on the X-direction side of the line G1' (the edge G14' on the X-direction side extends at an angle of 0 degrees (i.e. parallel to) or ±5 degrees relative to the edges S1*a*4'); the edge S1*b*4' on the X-direction side of the line S1*b*' is substantially parallel to the edge G24' on the X'-direction side of the line G2' (the edge G24' on the X'-direction side extends at an angle of 0 degrees (i.e. parallel to) or ±5 degrees relative to the edges S1*b*4'); and the distance between the edge S1*a*4' on the X'-direction side of the line S1*a*' and the edge G14' on the X-direction side of the line G1' is substantially the same as the distance between the edge S1*b*4' on the X-direction side of the line S1*b*' and the edge G24' on the X'-direction side of the line G2'. This arrangement allows impedance matching between the line S1*a*' and the line S1*b*'. Also, the line G2' is disposed next to and on the X'-direction side relative to the line S2*a*', and the line G3*a*' is disposed next to and on the X-direction side relative to the line S2*b*'; the edge S2*a*4' on the X'-direction side of the line S2*a*' is substantially parallel to the edge G24' on the X-direction side of the line G2' (the edge G24' on the X-direction side extends at an angle of 0 degrees (i.e. parallel to) or ±5 degrees relative to the edges S2*a*4'); the edge S2*b*4' on the X-direction side of the line S2*b*' is substantially parallel to the edge G3*a*4' on the X'-direction side of the line G3*a*' (the edge G3*a*4' on the X'-direction side extends at an angle of 0 degrees (i.e. parallel to) or ±5 degrees relative to the edges S2*b*4'); and the distance between the edge S2*a*4' on the X'-direction side of the line S2*a*' and the edge G24' on the X-direction side of the line G2' is substantially the same as the distance between the edge S2*b*4' on the X-direction side of the line S2*b*' and the edge G3*a*4' on the X'-direction side of the line G3*a*'. This arrangement allows impedance matching between the line S2*a*' and that of the line S2*b*'. It should be appreciated here (in this paragraph) that the lines S1*b*', S1*a*' respectively correspond to the one and the other first lines in the claims; the contact portions S1*b*1' and S1*a*1' correspond to the first contact portions in the claims; the connecting portions S1*b*2' and S1*a*2' correspond to the first connecting portions in the claims; the middle portions S1*b*3' and S1*a*3' correspond to the first middle portions in the claims; the lines S2*b*' and S2*a*' respectively correspond to the one and the other second lines in the claims; the contact portions S2*b*1' and S2*a*1' correspond to the second contact portions in the claims; the connecting portions S2*b*2' and S2*a*2' correspond to the second connecting portions in the claims; the middle portions S2*b*3' and S2*a*3' correspond to the second middle portions in the claims; the line G2' corresponds to the third line in the claims; the contact portion G21' corresponds to the third contact portion in the claims; the connecting portion G22' corresponds to the third connecting portion in the claims; the middle portion G23' corresponds to the third middle portion in the claims; the line G1' corresponds to the fourth line in the claims; the contact portion G11' corresponds to the fourth contact portion in the claims; the connecting portion G12' corresponds to the fourth connecting portion in the claims; the middle portion G13' corresponds to the fourth middle portion in the claims; the line G3*a*' corresponds to the fifth line in the claims; the contact portion G3*a*1' corresponds to the fifth contact portion in the claims; the connecting portion G3*a*2' corresponds to the fifth connecting portion in the claims; the middle portion G3*a*3' corresponds to the fifth middle portion in the claims.

Next, Line arrangement 2 will be described related to the lines the lines G2', S2*a*', S2*b*', G3*a*', G3*b*', S3*a*', S3*b*', and G4'. The edge G3*a*4' on the X'-direction side of the line G3*a*' is non-parallel to the edge G3*b*4' on the X-direction side of the line G3*b*', the edge G3*a*4' on the X'-direction side is substantially parallel to the edges S2*b*4' of the middle portion S2*b*3' of the line S2*b*' (the edge G3*a*4' on the X'-direction side extends at an angle of 0 degrees (i.e. parallel to) or ±5 degrees relative to the edges S2*b*4'), and the edge G3*b*4' on the X-direction side is substantially parallel to the edges S3*a*4' of the middle portion S3*a*3' of the line S3*a*' (the edge G3*b*4' on the X-direction side extends at an angle of 0 degrees (i.e. parallel to) or ±5 degrees relative to the edges S3*a*4'). This allows the inclination angle of the middle portions S2*a*3' and S2*b*3' relative to the contact portions S2*a*1' and S2*b*1' to be smaller than the inclination angle of the middle portions S3*a*3' and S3*b*3' relative to the contact portions S3*a*1' and S3*b*1', while maintaining parallelism between the edges S2*a*4' of the middle portion S2*a*3' of the line S2*a*' and the edges S2*b*4' of the middle portion S2*b*3' of the line S2*b*', and maintaining parallelism between the edges S3*a*4' of the middle portion S3*a*3' of the line S3*a*' and the edges S3*b*4' of the middle portion S3*b*3' of the line S3*b*'. This means that the inclination angles of the middle portions S2*a*3' and S2*b*3' do not depend on the inclination angles of the middle portions S3*a*3' and S3*b*3', so that it is possible to suppress the difference in length between the middle portions S2*a*3' and S2*b*3' and accordingly suppress the difference in length between the connecting portions S2*a*2' and S2*b*2'. That is, it is possible to reduce the difference in shape between the lines S2*a*' and S2*b*'. This leads to reduction of noise and signal loss of signals transmitted through the lines S2*a*' and S2*b*' and reduced degradation of the signals. Further advantageously, the line G2' is disposed next to and on the X'-direction side relative to the line S2*a*', and the line G3*a*' is disposed next to and on the X-direction side relative to the line S2*b*'; the edge S2*a*4' on the X'-direction side of the line S2*a*' is substantially parallel to the edge G24' on the X-direction side of the line G2' (the edge G24' on the X-direction side extends at an angle of 0 degrees (i.e. parallel to) or ±5 degrees relative to the edges S2*a*4'); the edge S2*b*4' on the X-direction side of the line S2*b*' is substantially parallel to the edge G3*a*4' on the X'-direction side of the line G3*a*' (the edge G3*a*4' on the X'-direction side extends at an angle of 0 degrees (i.e. parallel to) or ±5 degrees relative to the edges S2*b*4'); and the distance between the edge S2*a*4' on the X'-direction side of the line S2*a*' and the edge G24' on the X-direction side of the line G2' is substantially the same as the distance between the edge S2*b*4' on the X-direction side of the line S2*b*' and the edge G3*a*4' on the X'-direction side of the line G3*a*'. This arrangement allows impedance matching the line S2*a*' and the line S2*b*'. Also, the line G3*b*' is disposed next to and on the X'-direction side relative to the line S3*a*', and the line G4' is disposed next to and on the X-direction side relative to the line S3*b*'; the edge S3*a*4' on the X'-direction side of the line S3*a*' is substantially parallel to the edge G3*b*4' on the X-direction side of the line G3*b*' (the edge G3*b*4' on the X-direction side extends at an angle of 0 degrees (i.e. parallel to) or ±5 degrees relative to the edges S3*a*4'); the edge S3*b*4' on the X-direction side of the line S3*b*' is substantially parallel to the edge G44' on the X'-direction side of the line G4' (the edge G44' on the X'-direction side extends at an angle of 0 degrees (i.e. parallel to) or ±5 degrees relative to the edges S3*b*4'); and the distance between the edge S3*a*4' on the X'-direction side of the line S3*a*' and the edge G3*b*4' on the X-direction side of the line G3*b*' is substantially the same as the distance between the edge S3*b*4' on the X-direction side of the line S3*b*' and the edge G44' on the X'-direction side of the line G4'. This arrangement allows impedance matching between the line S3*a*' and the line S3*b*'. It should be appreciated here (in this paragraph) that the lines S2*b*' and S2*a*' respectively correspond to the one and the other first lines in the claims; the contact portions S2*b*1' and S2*a*1' correspond to the first contact portions in the claims; the connecting portions S2*b*2' and S2*a*2' correspond to the first connecting portions in the claims; the middle portions S2*b*3' and S2*a*3' correspond to the first middle portions in the claims; the lines S3*b*' and S3*a*' respectively correspond to the one and the other second lines in the claims; the contact portions S3*b*1' and S3*a*1' correspond to the second contact portions in the claims; the connecting portions S3*b*2' and S3*a*2' correspond to the second connecting portions in the claims; the middle portions S3*b*3' and S3*a*3' correspond to the second middle portion in the claims; the line G3*a*' corresponds to the sixth line in the claims; the contact portion G3*a*1' corresponds to the sixth contact portion in the claims; the connecting portion G3*a*2' corresponds to the sixth connecting portion in the claims; the middle portion G3*a*3' corresponds to the sixth middle portion in the claims; the edge G3*a*4' on the X'-direction side of the middle portion G3*a*3' corresponds to the other edge of the sixth middle portion in the claims; the line G3*b*' corresponds to the seventh line in the claims; the contact portion G3*b*1' corresponds to the seventh contact portion in the claims; the connecting portion G3*b*2' corresponds to the seventh connecting portion in the claims; the middle portion G3*b*3' corresponds to the seventh middle portion in the claims; the line G2' corresponds to the fourth line in the claims; the contact portion G21' corresponds to the fourth contact portion in the claims; the connecting portion G22' corresponds to the fourth connecting portion in the claims; the middle portion G23' corresponds to the fourth middle portion in the claims; the line G4' corresponds to the fifth line in the claims; the contact portion G41' corresponds to the fifth contact portion in the claims; the connecting portion G42' corresponds to the fifth connecting portion in the claims; and the middle portion G43' corresponds to the fifth middle portion in the claims.

The connector C and the transmission line structure S described above are not limited to the above embodiments and may be modified in any manner within the scope of the claims. Specific modifications will be described below in detail.

The connector of the invention may be any body having an insulating property and a plurality of terminals of the embodiment or the modification examples to be described; the body of the invention may be any insulator that can hold at least a pair of first terminals, a second terminal, and a third terminal of the embodiment or the modification examples to be described partially at a substantially same height and in spaced relation to each other along a first direction, or an insulator that can partially hold at least a pair of first terminals, a second terminal, a sixth terminal, and a seventh terminal of the embodiment or the modification examples to be described partially at a substantially same height and in spaced relation to each other along a first direction. For example, the body may have a plurality of holes or grooves to press-fit therein and hold the pair of first terminals, the second terminal, and the third terminal, or the pair of first terminals, the second terminal, the sixth terminal, and the seventh terminal.

The transmission line structure of the invention may be any structure including an insulator and a plurality of lines of the embodiment or the modification examples to be described. The insulator of the invention may be any insulator adapted to provide thereon a pair of first lines, a second line, and a third line of the embodiment or the modification examples to be described in spaced relation to each other along a first direction, or adapted to provide thereon a pair of first lines, a second line, a sixth line, and a seventh line of the embodiment or the modification examples to be described in spaced relation to each other along a first direction. For example, the insulator may be a plate or block of insulating resin.

The pair of first terminals of the invention may be any terminals meeting the following conditions. The pair of first terminals are differential signal terminals being next to each other and extending in a second direction crossing the first direction; one of the first terminals is located on one side in the first direction and the other first terminal is located on the other side in the first direction; the first terminals each include a first contact portion, a first connecting portion on a side in an oblique direction, including a component of the one side in the first direction and a component of the second direction, relative to the first contact portion, and a first middle portion extending from the first contact portion toward the first connecting portion in an oblique direction including a component of the one side in the first direction and a component of the second direction; the first middle portions each include a pair of edges in the first direction; and the edges of the first middle portions of the pair of first terminals are parallel to one another. The pair of first lines of the invention may be similar in configuration to the first terminals of the invention, except that they are differential signal lines on the insulator.

At least one second terminal will suffice for the invention. The at least one second terminal of the invention may be any terminal meeting the following conditions. The second terminal is a signal terminal extending in the second direction; the second terminal includes a second contact portion, a second connecting portion on a side in an oblique direction, including a component of the one side in the first direction and a component of the second direction, relative to the second contact portion, and a second middle portion extending from the second contact portion toward the second connecting portion in an oblique direction including a component of the one side in the first direction and a component of the second direction; the second middle portion is more inclined to the one side in the first direction than the first middle portion; the second middle portion includes a pair of edges in the first direction; and the edges are parallel to each other and non-parallel to the edges of the first middle portions. The second line of the invention may be similar in configuration to second terminal of the invention, except that it is a signal line on the insulator.

The third terminal of the invention may be any terminal meeting the following conditions. The third terminal is a ground terminal or low-speed signal terminal to transmit a signal at a lower speed than signals transmitted through the first and second terminals; the third terminal extends in the second direction and between the one first terminal and the second terminal; the third terminal includes a third contact portion, a third connecting portion on a side in an oblique direction, including a component of the one side in the first direction and a component of the second direction, relative to the third contact portion, and a third middle portion extending from the third contact portion toward the third connecting portion in an oblique direction including a component of the one side in the first direction and a component of the second direction; the third middle portion includes a pair of edges in the first direction; the edges are non-parallel to each other and including one edge and the other edge; the one edge is located next to the second middle portion of the second terminal and is substantially parallel to the edges of the second middle portion of the second terminal; and the other edge is located next to the first middle portion of the one first terminal and being substantially parallel to the edges of the first middle portion of the one first terminal.

The distance between the pair of edges of the third middle portion of the third terminal of the invention may be smaller than the distance between the pair of edges of the first middle portion of each first terminal and/or than the distance between the pair of edges of the second middle portion of the at least one second terminal. The largest distance in the first direction between the pair of edges of the third middle portion of the third terminal of the invention may be larger than the distance in the first direction between the pair of edges of the first middle portion of each first terminal and than the distance between the pair of edges of the second middle portion of the second terminal, and the smallest distance in the first direction between the pair of edges of the third middle portion of the third terminal of the invention may be smaller than the distance in the first direction between the pair of edges of the first middle portion of each first terminal and than the distance in the first direction between the pair of edges of the second middle portion of the second terminal. An intermediate distance in the first direction between the pair of edges of the third middle portion of the third terminal of the invention may be larger than the distance in the first direction between the pair of edges of the first middle portion of each first terminal and than the distance in the first direction between the pair of edges of the second middle portion of the second terminal, and the smallest distance in the first direction between the pair of edges of the third middle portion of the third terminal of the invention may be smaller than the distance in the first direction between the pair of edges of the first middle portion of each first terminal and than the distance in the first direction between the pair of edges of the second middle portion of the second terminal. The third line of the invention may be similar in configuration to the third terminal of the invention, except that it is a ground line or low-speed signal line on the insulator.

The sixth terminal of the invention may be any terminal meeting the following conditions. The sixth terminal is a ground terminal or low-speed signal terminal to transmit a signal at a lower speed than signals transmitted through the first and second terminals; the sixth terminal extends in the second direction so as to be located between the one first terminal and the second terminal and next to the one first terminal; the sixth terminal includes a sixth contact portion, a sixth connecting portion on a side in an oblique direction, including a component of the one side in the first direction and a component of the second direction, relative to the sixth contact portion, and a sixth middle portion extending from the sixth contact portion toward the sixth connecting portion in an oblique direction including a component of the one side in the first direction and a component of the second direction; the sixth middle portion includes a pair of edges in the first direction; the edges include one edge and the other edge; the other edge are located next to the first middle portion of the one first terminal and substantially parallel to the edges of the first middle portion of the one first terminal.

The distance between the pair of edges of the sixth middle portion of the sixth terminal of the invention may be smaller than the distance between the pair of edges of the first middle portion of each first terminal. The largest distance in the first direction between the pair of edges of the sixth middle portion of the sixth terminal of the invention may be larger than the distance in the first direction between the pair of edges of the first middle portion each first terminal, and the smallest distance in the first direction between the pair of edges of the sixth middle portion of the sixth terminal of the invention may be smaller than the distance in the first direction between the pair of edges of the first middle portion of each first terminal. An intermediate distance in the first direction between the pair of edges of the sixth middle portion of the sixth terminal of the invention may be larger than the distance in the first direction between the pair of edges of the first middle portion of each first terminal, and the smallest distance in the first direction between the pair of edges of the sixth middle portion of the sixth terminal of the invention may be smaller than the distance in the first direction between the pair of edges of the first middle portion of each first terminal. The sixth line of the invention may be similar in configuration to the sixth terminal of the invention, except that it is a ground line or low-speed signal line on the insulator.

The seventh terminal of the invention may be any terminal meeting the following conditions. The seventh terminal is a ground terminal or low-speed signal terminal to transmit a signal at a lower speed than signals transmitted through the first and second terminals; the seventh terminal extends in the second direction so as to be located between the one first terminal and the second terminal and next to the second terminal; the seventh terminal includes a seventh contact portion, a seventh connecting portion on a side in an oblique direction, including a component of the one side in the first direction and a component of the second direction, relative to the seventh contact portion, and a seventh middle portion extending from the seventh contact portion toward the seventh connecting portion in an oblique direction including a component of the one side in the first direction and a component of the second direction; the seventh middle portion includes a pair of edges in the first direction; the edges include one edge and the other edge; the one edge is located next to the second middle portion of the second terminal and is substantially parallel to the edges of the second middle portion of the second terminal and non-parallel to the other edge of the sixth middle portion of the sixth terminal.

The distance between the pair of edges of the seventh middle portion of the seventh terminal of the invention may be smaller than the distance between the pair of edges of the second middle portion of the at least one second terminal. The largest distance in the first direction between the pair of edges of the seventh middle portion of the seventh terminal of the invention may be larger than the distance in the first direction between the pair of edges of the second middle portion of the second terminal, and the smallest distance in the first direction between the pair of edges of the seventh middle portion of the seventh terminal of the invention may be smaller than the distance in the first direction between the pair of edges of the second middle portion of the second terminal. An intermediate distance in the first direction between the pair of edges of the seventh middle portion of the seventh terminal of the invention may be larger than the distance in the first direction between the pair of edges of the second middle portion of the second terminal, and the smallest distance in the first direction between the pair of edges of the seventh middle portion of the seventh terminal of the invention may be smaller than the distance in the first direction between the pair of edges of the second middle portion of the second terminal. The seventh line of the invention may be similar in configuration to the seventh terminal of the invention, except that it is a ground line or low-speed signal line on the insulator.

The sixth terminal of the embodiment or the modification examples and the seventh terminal of the embodiment or the modification examples need not be next to each other, and at least one eighth terminal may be disposed between the sixth terminal and the seventh terminal. The eighth terminal only needs to be held in the body of the embodiment or the modification examples. The sixth line of the embodiment or the modification examples and the seventh line of the embodiment or the modification examples need not be next to each other, and at least one eighth line may be disposed between the sixth line and the seventh line. The eighth line only needs to be held in the insulator of the embodiment or the modification examples.

The fourth terminal may be omitted in the invention. The fourth terminal of the invention is any ground terminal or low-speed signal terminal to transmit a signal at a lower speed than signals transmitted through the first terminals, the fourth terminal extending in the second direction so as to be partially held in the body on the other side in the first direction relative to the other first terminal. The fourth terminal of the invention may be also press-fitted and held in a hole or groove in the body. The fourth line of the invention may be similar in configuration to the fourth terminal of the invention, except that it is a ground line or low-speed signal line on the insulator.

The fifth terminal may be omitted in the invention. The fifth terminal of the invention may be any ground terminal or low-speed signal terminal to transmit a signal at a lower speed than signals transmitted through the second terminals, the fifth terminal extending in the second direction so as to be partially held in the body on the one side in the first direction relative to the one second terminal. The fifth terminal of the invention may be also press-fitted and held in a hole or groove in the body. The fifth line of the invention may be similar in configuration to the fifth terminal of the invention, except that it is a ground line or low-speed signal line on the insulator.

The contact portions of the embodiment or the modification examples may be linear in shape. Of the contact portions of the embodiment or the modification examples, at least one of them may be different in length from the other contact portions, or all the contact portions may be different in length from each other. The boundary portions between the contact portions and the middle portions of the embodiment or the modification examples need not be arranged side by side along the X-X' direction.

Of the connecting portions of the embodiment or the modification examples, at least one of them may be different in length from the other connecting portions, or all the connecting portions may be different in length from each other. For example, the connecting portions of the ground terminals or of the low-speed signal terminals may be longer or shorter than the connecting portions of the differential signal terminals. The connecting portions of the ground lines or of the low-speed signal lines may be longer or shorter than the connecting portions of the differential signal lines. The boundary portions between the connecting portions and the middle portions of the embodiment or the modification examples need not be arranged side by side along the X-X' direction. The connecting portions of the embodiment or the modification examples may be located relative to the contact portions of the embodiment or the modification examples on a side in an oblique direction including the X-, Y'-, and Z-direction components or including the X-, Y-, and Z'-direction components. In these cases, the middle portions of the embodiment or the modification examples may extend (be inclined) in an oblique direction including the X-, Y'-, and Z-direction components or including the X-, Y'-, and Z'-direction components.

The connecting portions of the embodiment or the modification examples each may include a connecting body located on a side in an oblique direction including X- and Y'-direction components relative to the contact portion of the embodiment or the modification examples, and an extending portion extending from the connecting portion body in a direction including the Z- or Z'-direction component.

It should be appreciated that the connector C and the transmission line structure S of the embodiments and the modification examples are described above by way of examples only and may have any materials, shapes, dimensions, numbers, arrangements, and other configurations if they can perform similar functions. The configurations of the embodiments and the modifications described above may be combined in any possible manner. The first direction (X-X' direction) of the invention may be set in any manner as long as it is an array direction in which the terminals or the lines of the embodiment or the modification examples are arranged in spaced relation; the second direction (the Y-Y' direction) of the invention may be any direction crossing the first direction; the third direction (Z-Z' direction) of the invention may be set in any manner as long as it crosses the first direction and the second direction. In each of the first, second, and third directions of the invention, either side of each direction may be the one side of the direction, and the other side may be the other side of the direction.

REFERENCE SIGNS LIST

C: Connector
100: Body
200: Terminal group
S1*a*, S1*b*: Terminal
S1*a*1, S1*b*1: Contact portion
S1*a*2, S1*b*2: Connecting portion
S1*a*3, S1*b*3: Middle portion
S1*a*4, S1*b*4: Edge
S1*a*5, S1*b*5: Boundary portion
S1*a*6, S1*b*6: Boundary portion
S2*a*, S2*b*: Terminal
S2*a*1, S2*b*1: Contact portion
S2*a*2, S2*b*2: Connecting portion
S2*a*3, S2*b*3: Middle portion
S2*a*4, S2*b*4: Edge
S2*a*5, S2*b*5: Boundary portion
S2*a*6, S2*b*6: Boundary portion
S3*a*, S3*b*: Terminal
S3*a*1, S3*b*1: Contact portion
S3*a*2, S3*b*2: Connecting portion
S3*a*3, S3*b*3: Middle portion
S3*a*4, S3*b*4: Edge
S3*a*5, S3*b*5: Boundary portion
S3*a*6, S3*b*6: Boundary portion
S4*a*, S4*b*: Terminal
S4*a*1, S4*b*1: Contact portion
S4*a*2, S4*b*2: Connecting portion
S4*a*3, S4*b*3: Middle portion
S4*a*4, S4*b*4: Edge
S4*a*5, S4*b*5: Boundary portion
S4*a*6, S4*b*6: Boundary portion
G1: Terminal
G11: Contact portion
G12: Connecting portion
G13: Middle portion
G14: Edge
G15: Boundary portion
G16: Boundary portion
G2: Terminal
G21: Contact portion
G22: Connecting portion
G23: Middle portion
G24: Edge
G25: Boundary portion
G26: Boundary portion
G3*a*, G3*b*: Terminal
G3*a*1, G3*b*1: Contact portion
G3*a*2, G3*b*2: Connecting portion
G3*a*3, G3*b*3: Middle portion
G3*a*4, G3*b*4: Edge
G3*a*5, G3*b*5: Boundary portion
G3*a*6, G3*b*6: Boundary portion
G4: Terminal G41: Contact portion
G42: Connecting portion
G43: Middle portion
G44: Edge
G45: Boundary portion
G46: Boundary portion
G5: Terminal
G51: Contact portion
G52: Connecting portion
G53: Middle portion
G54: Edge
G55: Boundary portion
G56: Boundary portion
S: transmission line structure
300: Insulator
400: Line group
S1*a*', S1*b*': Line
S1*a*1', S1*b*1': Contact portion
S1*a*2', S1*b*2': Connecting portion
S1*a*3', S1*b*3': Middle portion
S1*a*4', S1*b*4': Edge
S1*a*5', S1*b*5': Boundary portion
S1*a*6', S1*b*6': Boundary portion
S2*a*', S2*b*': Line
S2*a*1', S2*b*1': Contact portion
S2*a*2', S2*b*2': Connecting portion
S2*a*3', S2*b*3': Middle portion
S2*a*4', S2*b*4': Edge
S2*a*5', S2*b*5': Boundary portion
S2*a*6', S2*b*6': Boundary portion
S3*a*', S3*b*': Line
S3*a*1', S3*b*1': Contact portion
S3*a*2', S3*b*2': Connecting portion
S3*a*3', S3*b*3': Middle portion
S3*a*4', S3*b*4': Edge
S3*a*5', S3*b*5': Boundary portion
S3*a*6', S3*b*6': Boundary portion
S4*a*', S4*b*': Line
S4*a*1', S4*b*1': Contact portion
S4*a*2', S4*b*2': Connecting portion
S4*a*3', S4*b*3': Middle portion
S4*a*4', S4*b*4': Edge
S4*a*5', S4*b*5': Boundary portion
S4*a*6', S4*b*6': Boundary portion
G1': Line
G11': Contact portion
G12': Connecting portion
G13': Middle portion
G14': Edge
G15': Boundary portion
G16': Boundary portion
G2': Terminal
G21': Contact portion
G22': Connecting portion
G23': Middle portion
G24': Edge
G25': Boundary portion
G26': Boundary portion
G3*a*', G3*b*': Line
G3*a*1', G3*b*1': Contact portion
G3*a*2', G3*b*2': Connecting portion
G3*a*3', G3*b*3': Middle portion
G3*a*4', G3*b*4': Edge
G3*a*5', G3*b*5': Boundary portion
G3*a*6', G3*b*6': Boundary portion
G4': Line
G41': Contact portion
G42': Connecting portion
G43': Middle portion
G44': Edge
G45': Boundary portion
G46': Boundary portion

The invention claimed is:

1. A connector comprising:

a body having an insulation property; and a pair of first terminals, a second terminal, and a third terminal that are partially held in the body at a substantially same height and spaced from each other along a first direction, wherein the first terminals are differential signal terminals being next to each other and extending in a second direction crossing the first direction, one of the first terminals being located on one side in the first direction and the other first terminal being located on the other side in the first direction, the first terminals each including:

a first contact portion;

a first connecting portion on a side in an oblique direction, including a component of the one side in the first direction and a component of the second direction, relative to the first contact portion; and a first middle portion extending from the first contact portion toward the first connecting portion in an oblique direction including a component of the one side in the first direction and a component of the second direction, the first middle portion including a pair of edges in the first direction, the edges of the first middle portions of the pair of first terminals being parallel to one another, the second terminal is a signal terminal extending in the second direction and including:

a second contact portion;

a second connecting portion on a side in an oblique direction, including a component of the one side in the first direction and a component of the second direction, relative to the second contact portion; and a second middle portion extending from the second contact portion toward the second connecting portion in an oblique direction including a component of the one side in the first direction and a component of the second direction, the second middle portion being more inclined to the one side in the first direction than the first middle portion, the second middle portion including a pair of edges in the first direction, the edges of the second middle portion being parallel to each other and non-parallel to the edges of the first middle portions, and the third terminal is a ground terminal or low-speed signal terminal to transmit a signal at a lower speed than signals transmitted through the first and second terminals, the third terminal extending in the second direction and between the one first terminal and the second terminal, the third terminal including:

a third contact portion;

a third connecting portion on a side in an oblique direction, including a component of the one side in the first direction and a component of the second direction, relative to the third contact portion; and a third middle portion extending from the third contact portion toward the third connecting portion in an oblique direction including a component of the one side in the first direction and a component of the second direction, the third middle portion including a pair of edges in the first direction, the edges of the third middle portion being non-parallel to each other and including one edge and the other edge, the one edge of the third middle portion being located next to the second middle portion of the second terminal and being substantially parallel to the edges of the second middle portion of the second terminal, and the other edge of the third middle portion being located next to the first middle portion of the one first terminal and being substantially parallel to the edges of the first middle portion of the one first terminal.

2. The connector according to claim 1, wherein the second terminal comprises a pair of second terminals being differential signal terminals next to each other and including one of the second terminals located on the one side in the first direction and the other second terminal located on the other side in the first direction, the edges of the second middle portions of the pair of second terminals are parallel to one another and non-parallel to the edges of the first middle portions, the third terminal is disposed between the one first terminal and the other second terminal, and the one edge of the third middle portion of the third terminal is located next to the second middle portion of the other second terminal and is substantially parallel to the edges of the second middle portion of the other second terminal.

3. The connector according to claim 2, further comprising:

a fourth terminal being a ground terminal or low-speed signal terminal to transmit a signal at a lower speed than signals transmitted through the first terminals, the fourth terminal extending in the second direction to be partially held in the body on the other side in the first direction relative to the other first terminal; and a fifth terminal being a ground terminal or low-speed signal terminal to transmit a signal at a lower speed than signals transmitted through the second terminals, the fifth terminal extending in the second direction to be partially held in the body on the one side in the first direction relative to the one second terminal.

4. The connector according to claim 3, wherein the fourth terminal includes:

a fourth contact portion;

a fourth connecting portion on a side in a direction, including a component of the second direction, relative to the fourth contact portion; and a fourth middle portion between the fourth contact portion and the fourth connecting portion, the fourth middle portion including a pair of edges in the first direction, one of the edges of the fourth middle portion being located next to the first middle portion of the other first terminal and being substantially parallel to the edges of the first middle portion of the other first terminal, the fifth terminal includes:

a fifth contact portion;

a fifth connecting portion on a side in a direction, including a component of the second direction, relative to the fifth contact portion; and a fifth middle portion extending between the fifth contact portion and the fifth connecting portion, the fifth middle portion including a pair of edges in the first direction including one edge and the other edge, and the other edge of the fifth middle portion being located next to the second middle portion of the one second terminal and being substantially parallel to the edges of the second middle portion of the one second terminal, a distance between the first middle portion of the one first terminal and the third middle portion of the third terminal is substantially the same as a distance between the first middle portion of the other first terminal and the fourth middle portion of the fourth terminal, and a distance between the second middle portion of the one second terminal and the fifth middle portion of the fifth terminal is substantially the same as a distance between the second middle portion of the other second terminal and the third middle portion of the third terminal.

5. The connector according to claim 1, wherein the first terminals each further include a boundary portion between the first connecting portion and the first middle portion, the second terminal further includes a boundary portion between the second connecting portion and the second middle portion, the third terminal further includes a boundary portion between the third connecting portion and the third middle portion, and the boundary portions of the first, second, and third terminals are arranged side by side along the first direction.

6. The connector according to claim 1, wherein the first terminals each further include a boundary portion between the first contact portion and the first middle portion, the second terminal further includes a boundary portion between the second contact portion and the second middle portion, the third terminal further includes a boundary portion between the third contact portion and the third middle portion, and the boundary portions of the first, second, and third terminals are arranged side by side along the first direction.

7. The connector according to claim 1, wherein a largest distance in the first direction between the edges of the third middle portion of the third terminal is larger than a distance in the first direction between the edges of the first middle portion of each first terminal and than a distance in the first direction between the edges of the second middle portion of the second terminal.

8. The connector according to claim 1, wherein the third middle portion includes:

a first part on a side of the third connecting portion, and a second part on a side of the third contact portion, and the first part is larger than the second part in dimension in the first direction.

9. The connector according to claim 1, wherein a distance in the first direction between the edges of the third middle portion gradually increases from the third contact portion toward the third connecting portion.

10. The connector according to claim 1, wherein the one edge of the third middle portion extends at an angle of 0 degrees or ±5 degrees relative to the edges of the second middle portion, the other edge of the third middle portion extends at an angle of 0 degrees or ±5 degrees relative to the edges of the first middle portion of the one first terminal.

11. A connector comprising:

a body having an insulation property; and a pair of first terminals, a second terminal, a sixth terminal, and a seventh terminal that are partially held in the body at a substantially same height and spaced from each other along a first direction, wherein the first terminals are differential signal terminals being next to each other and extending in a second direction crossing the first direction, one of the first terminals being located on one side in the first direction and the other first terminal being located on the other side in the first direction, the first terminals each including:

a first contact portion;

a first connecting portion on a side in an oblique direction, including a component of the one side in the first direction and a component of the second direction, relative to the first contact portion; and a first middle portion extending from the first contact portion toward the first connecting portion in an oblique direction including a component of the one side in the first direction and a component of the second direction, the first middle portion including a pair of edges in the first direction, the edges of the first middle portions of the pair of first terminals being parallel to one another, the second terminal is a signal terminal extending in the second direction and including:

a second contact portion;

a second connecting portion on a side in an oblique direction, including a component of the one side in the first direction and a component of the second direction, relative to the second contact portion; and a second middle portion extending from the second contact portion toward the second connecting portion in an oblique direction including a component of the one side in the first direction and a component of the second direction, the second middle portion being more inclined to the one side in the first direction than the first middle portion, the second middle portion including a pair of edges in the first direction, the edges of the second terminal being parallel to each other and non-parallel to the edges of the first middle portions, the sixth terminal is a ground terminal or low-speed signal terminal to transmit a signal at a lower speed than signals transmitted through the first and second terminals, the sixth terminal extending in the second direction so as to be located between the one first terminal and the second terminal and next to the one first terminal, the sixth terminal including:

a sixth contact portion;

a sixth connecting portion on a side in an oblique direction, including a component of the one side in the first direction and a component of the second direction relative to the sixth contact portion; and a sixth middle portion extending from the sixth contact portion toward the sixth connecting portion in an oblique direction including a component of the one side in the first direction and a component of the second direction, the sixth middle portion including a pair of edges in the first direction, the edges of the sixth middle portion including one edge and the other edge, the other edge of the sixth middle portion being located next to the first middle portion of the one first terminal and being substantially parallel to the edges of the first middle portion of the one first terminal, and the seventh terminal is a ground terminal or low-speed signal terminal to transmit a signal at a lower speed than signals transmitted through the first and second terminals, the seventh terminal extending in the second direction so as to be located between the one first terminal and the second terminal and next to the second terminal, the seventh terminal including:

a seventh contact portion;

a seventh connecting portion on a side in an oblique direction, including a component of the one side in the first direction and a component of the second direction relative to the seventh contact portion; and a seventh middle portion extending from the seventh contact portion toward the seventh connecting portion in an oblique direction including a component of the one side in the first direction and a component of the second direction, the seventh middle portion including a pair of edges in the first direction, the edges of the seventh middle portion including one edge and the other edge, the one edge of the seventh middle portion being located next to the second middle portion of the second terminal and being substantially parallel to the edges of the second middle portion of the second terminal and non-parallel to the other edge of the sixth middle portion of the sixth terminal.

12. The connector according to claim 11, wherein the second terminal comprises a pair of second terminals being differential signal terminals next to each other and including one of the second terminals located on the one side in the first direction and the other second terminal located on the other side in the first direction, the edges of the second middle portions of the pair of second terminals are parallel to one another and non-parallel to the edges of the first middle portions, the sixth terminal is located between the one first terminal and the other second terminal and next to the one first terminal, the seventh terminal is located between the one first terminal and the other second terminal and next to the other second terminal, and the one edge of the seventh middle portion of the seventh terminal is located next to the second middle portion of the other second terminal, is substantially parallel to the edges of the second middle portion of the other second terminal, and is non-parallel to the other edge of the sixth middle portion of the sixth terminal.

13. The connector according to claim 12, further comprising a fourth terminal and a fifth terminal, wherein the fourth terminal is a ground terminal or low-speed signal terminal to transmit a signal at a lower speed than signals transmitted through the first terminals, the fourth terminal extending in the second direction so as to be partially held in the body on the other side in the first direction relative to the other first terminal, and the fifth terminal is a ground terminal or low-speed signal terminal to transmit a signal at a lower speed than signals transmitted through the second terminals, the fifth terminal extending in the second direction so as to be partially held in the body on the one side in the first direction relative to the one second terminal.

14. The connector according to claim 13, wherein the fourth terminal includes:

a fourth contact portion;

a fourth connecting portion on a side in a direction, including a component of the second direction, relative to the fourth contact portion; and a fourth middle portion between the fourth contact portion and the fourth connecting portion, the fourth middle portion including a pair of edges in the first direction, one of the edges of the fourth middle portion being located next to the first middle portion of the other first terminal and being substantially parallel to the edges of the first middle portion of the other first terminal, the fifth terminal includes:

a fifth contact portion;

a fifth connecting portion on a side in a direction, including a component of the second direction, relative to the fifth contact portion; and a fifth middle portion extending between the fifth contact portion and the fifth connecting portion, the fifth middle portion including a pair of edges in the first direction including one edge and the other edge, and the other edge of the fifth middle portion being located next to the second middle portion of the one second terminal and being substantially parallel to the edges of the second middle portion of the one second terminal, a distance between the first middle portion of the one first terminal and the sixth middle portion of the sixth terminal is substantially the same as a distance between the first middle portion of the other first terminal and the fourth middle portion of the fourth terminal, and a distance between the second middle portion of the one second terminal and the fifth middle portion of the fifth terminal is substantially the same as a distance between the second middle portion of the other second terminal and the seventh middle portion of the seventh terminal.

15. The connector according to claim 11, wherein the first terminals each further include a boundary portion between the first connecting portion and the first middle portion, the second terminal further includes a boundary portion between the second connecting portion and the second middle portion, the sixth terminal further includes a boundary portion between the sixth connecting portion and the sixth middle portion, the seventh terminal further includes a boundary portion between the seventh connecting portion and the seventh middle portion, and the boundary portions of the first, second, the terminal, and seventh terminals are arranged side by side along the first direction.

16. The connector according to claim 7, wherein the first terminals each further include a boundary portion between the first contact portion and the first middle portion, the second terminal further includes a boundary portion between the second contact portion and the second middle portion, the sixth terminal further includes a boundary portion between the sixth contact portion and the sixth middle portion, the seventh terminal further includes a boundary portion between the seventh contact portion and the seventh middle portion, and the boundary portions of the first, second, sixth, and seventh terminals are arranged side by side along the first direction.

17. The connector according to claim 11, wherein a largest distance in the first direction between the edges of the sixth middle portion of the sixth terminal is larger than a distance in the first direction between the edges of the first middle portion of each first terminal, and than a distance in the first direction between the edges of the second middle portion of the second terminal, and a largest distance in the first direction between the edges of the seventh middle portion of the seventh terminal is larger than a distance in the first direction between the edges of the first middle portion of each first terminal, and than a distance in the first direction between the edges of the second middle portion of the second terminal.

18. The connector according to claim 11, wherein the other edge of the sixth middle portion extends at an angle of 0 degrees or ±5 degrees relative to the edges of the first middle portion of the one first terminal, the one edge of the seventh middle portion extends at an angle of 0 degrees or ±5 degrees relative to the edges of the second middle portion.

19. A transmission line structure comprising:

an insulator; and a pair of first lines, a second line, and a third line that are provided on the insulator in spaced relation from each other along a first direction, wherein the first lines are differential signal lines being next to each other and extending in a second direction crossing the first direction, one of the first lines being located on one side in the first direction and the other first line being located on the other side in the first direction, the first lines each including:

a first contact portion;

a first connecting portion on a side in an oblique direction, including a component of the one side in the first direction and a component of the second direction, relative to the first contact portion; and a first middle portion extending from the first contact portion toward the first connecting portion in an oblique direction including a component of the one side in the first direction and a component of the second direction, the first middle portion including a pair of edges in the first direction, the edges of the first middle portions of the pair of first terminals being parallel to one another, the second line is a signal line extending in the second direction, the second line including:

a second contact portion;

a second connecting portion on a side in an oblique direction, including a component of the one side in the first direction and a component of the second direction, relative to the second contact portion; and a second middle portion extending from the second contact portion toward the second connecting portion in an oblique direction including a component of the one side in the first direction and a component of the second direction, the second middle portion being more inclined to the one side in the first direction than the first middle portion, the second middle portion including a pair of edges in the first direction, the edges of the second middle portion being parallel to each other and non-parallel to the edges of the first middle portions, and the third line is a ground line or a low-speed signal line to transmit a signal at a lower speed than signals transmitted through the first and second lines, the third line extending in the second direction and between the one first line and the second line, the third line including:

a third contact portion;

a third connecting portion on a side in an oblique direction, including a component of the one side in the first direction and a component of the second direction, relative to the third contact portion; and a third middle portion extending from the third contact portion toward the third connecting portion in an oblique direction including a component of the one side in the first direction and a component of the second direction, the third middle portion including a pair of edges in the first direction, the edges of the third middle portion being non-parallel to each other and including one edge and the other edge, the one edge of the third middle portion being located next to the second middle portion of the second line and being substantially parallel to the edges of the second middle portion of the second line, and the other edge of the third middle portion being located next to the first middle portion of the one first line and being substantially parallel to the edges of the first middle portion of the one first line.

* * * * *